US005750303A

United States Patent [19]

Inaba et al.

[11] Patent Number: 5,750,303

[45] Date of Patent: May 12, 1998

[54] TONER FOR DEVELOPING ELECTROSTATIC IMAGE

[75] Inventors: Kohji Inaba, Yokohama; Kazunori Kato, Mitaka; Kengo Hayase, Toride, all of Japan

[73] Assignee: Canon Kabushiki Kaisha, Tokyo, Japan

[21] Appl. No.: 841,337

[22] Filed: Apr. 30, 1997

Related U.S. Application Data

[63] Continuation of Ser. No. 649,464, May 17, 1996, abandoned.

[30] Foreign Application Priority Data

May 22, 1995 [JP] Japan ..... 7-145201

[51] Int. Cl.[6] ..... G03G 9/087; G03G 9/097

[52] U.S. Cl. ..... 430/110; 430/111; 430/124; 430/137

[58] Field of Search ..... 430/110, 111, 430/137

[56] References Cited

U.S. PATENT DOCUMENTS

| | | | |
|---|---|---|---|
| 2,297,691 | 10/1942 | Carlson | 430/31 |
| 3,666,363 | 5/1972 | Tanaka et al. . | |
| 4,071,361 | 1/1978 | Marushima . | |
| 4,578,338 | 3/1986 | Gruber et al. | 430/120 |
| 4,863,825 | 9/1989 | Yoshimoto et al. | 430/109 |
| 4,917,982 | 4/1990 | Tomono et al. | 430/99 |
| 4,921,771 | 5/1990 | Tomono et al. | 430/110 |
| 4,960,664 | 10/1990 | Yamada et al. | 430/109 |
| 5,510,222 | 4/1996 | Inaba et al. | 430/109 |

FOREIGN PATENT DOCUMENTS

| | | |
|---|---|---|
| 0421416 | 4/1991 | European Pat. Off. . |
| 0495476 | 7/1992 | European Pat. Off. . |
| 0621511 | 10/1994 | European Pat. Off. . |
| 0621513 | 10/1994 | European Pat. Off. . |
| 0643336 | 3/1995 | European Pat. Off. . |
| 36-10231 | 7/1961 | Japan . |
| 52-3304 | 1/1977 | Japan . |
| 52-3305 | 1/1977 | Japan . |
| 57-52574 | 11/1982 | Japan . |
| 59-053856 | 3/1984 | Japan . |
| 59-61842 | 4/1984 | Japan . |
| 60-217366 | 10/1985 | Japan . |
| 60-252360 | 12/1985 | Japan . |
| 61-94062 | 5/1986 | Japan . |
| 61-138259 | 6/1986 | Japan . |
| 61-273554 | 12/1986 | Japan . |
| 62-14166 | 1/1987 | Japan . |
| 62-106473 | 5/1987 | Japan . |
| 63-186253 | 8/1988 | Japan . |
| 1-109359 | 5/1989 | Japan . |
| 2-79860 | 3/1990 | Japan . |
| 3-50559 | 3/1991 | Japan . |
| 5-341573 | 12/1993 | Japan . |

*Primary Examiner*—Roland Martin

*Attorney, Agent, or Firm*—Fitzpatrick, Cella, Harper & Scinto

[57] ABSTRACT

A toner for developing an electrostatic image includes toner particles constituted by at least a binder resin, a colorant, a polar resin and a release agent. The polar resin has at least one terminal group which has been modified by a polycarbonate acid having at least three carboxyl groups. The polar resin has an acid value of 3–35 mgKOH/g. The polar resin may preferably be a polyester resin having an acid value of 4–35 mgKOH/g and having a number-average molecular weight (Mn) of 3,000–15,000, a weight-average molecular weight (Mw) of 6,000–50,000, and an Mw/Mn of 1.2–3.0 based on GPC. The polar resin (preferably polyester resin) having modified by a polycarboxylic acid having at least three carboxylic groups to provide a specific acid value is effective in improving resultant toner performances, such as low-temperature fixability, anti-offset characteristic at high temperatures, triboelectric chargeability, and flowability.

45 Claims, 9 Drawing Sheets

TONER FOR DEVELOPING ELECTROSTATIC IMAGE

This application is a continuation of application Ser. No. 08/649,464 filed May 17, 1996, now abandoned.

FIELD OF THE INVENTION AND RELATED ART

The present invention relates to a toner for developing electrostatic images used in image forming methods, such as electrophotography, and electrostatic printing, particularly a toner suitable for heat and pressure fixation.

Hitherto, a large number of electrophotographic processes have been known, inclusive of those disclosed in U.S. Pat. Nos. 2,297,691; 3,666,363; and 4,071,361. In these processes, in general, an electrostatic latent image is formed on a photosensitive member by various means, then the latent image is developed with a toner, and the resultant toner image is, after being directly or indirectly transferred onto a transfer(-receiving) material such as paper etc., as desired, fixed by heating, pressing, or heating and pressing, or with solvent vapor to obtain a copy or print carrying a fixed toner image. A portion of the toner remaining on the photosensitive member without being transferred is cleaned by various means, and the above mentioned steps are repeated for a subsequent cycle of image formation.

Hitherto, in order to prevent the attachment of a toner onto a fixing roller surface, it has been practiced to compose the roller surface of a material (such as a silicone rubber or a fluorine-containing resin) showing excellent releasability against a toner, and coat the roller surface with a film of a liquid showing a high releasability, such as silicone oil or a fluorine-containing oil, for the purpose of preventing offset and deterioration of the roller surface. However, such a measure, though very effective for preventing toner offset, requires an equipment for supplying the offset-preventing liquid and complicates the fixing device. Further, the oil application is accompanied with another difficulty that peeling between (elastic) layers constituting the fixing roller is caused thereby to shorten the life of the fixing roller.

Accordingly, based on a concept of dispensing with a silicone oil applicator and supplying an offset-preventing liquid from the inside of the toner particles on heating, it has been practiced to add a release agent, such as low-molecular weight polyethylene or low-molecular weight polypropylene in the toner particles.

Incorporation of a wax as a release agent in toner particles has been proposed in Japanese Patent Publication (JP-B) 52-3304, JP-B 52-3305, and Japanese Laid-Open Patent Application (JP-A) 57-52574.

Similar proposals have also been made in JP-A 3-50559, JP-A 2-79860, JP-A 1-109359, JP-A 62-14166, JP-A 61-273554, JP-A 61-94062, JP-A 61-138259, JP-A 60-252361, JP-A 60-252360, and JP-A 60-217366.

Such a wax has been used to improve the anti-offset characteristic of a toner at the time of a low-temperature fixation or a high-temperature fixation and the fixability of a toner at the time of a low-temperature fixation. On the other hand, the use of a wax may be accompanied with difficulties such as a lowering in anti-blocking characteristic of a toner, a deterioration in developing performance due to heating of the interior of an image forming apparatus, etc., and a deterioration in developing performance due to migration of the wax to the toner particle surface when the toner is left standing for a long period.

In order to overcome the above-mentioned problems, there has been proposed a toner production process utilizing suspension polymerization in JP-B 36-10231. In such a toner production process by suspension polymerization, a monomer composition is prepared by uniformly dissolving or dispersing a polymerizable monomer, a colorant, and optional additives (such as a polymerization initiator, a crosslinking agent, a charge control agent and others) and the resultant monomer composition is dispersed by appropriate stirring means into a continuous phase medium (e.g., water) containing a dispersion stabilizer, followed by polymerization to obtain a toner having a desired particle size.

Further, according to JP-A 5-341573, by adding a polar component having a polar group to a monomer composition in an aqueous dispersion medium, the polar component contained in the monomer composition becomes liable to be present at a surface layer portion which is a boundary (interface) with an aqueous phase and a non-polar component is not readily present at the surface layer portion. As a result, toner particles are allowed to have a core/shell structure.

By incorporation of a wax into toner particles, a toner produced through the suspension polymerization process can not only satisfy an anti-blocking characteristic and an anti-offset characteristic at high temperatures which are contradictory to each other at the same time but also suppress high-temperature offset without applying a release agent (e.g., oil) onto a fixation roller.

However, in recent years, there is a great user demand for a further smaller, lighter, higher-quality and more reliable image forming apparatus. In order to satisfy such a demand, there has been desired to provide a toner having further excellent performances.

Further, a copying machine or a printer for full-color image formation is becoming to be used. A full-color image is generally formed through a process as follows. A photosensitive member is uniformly charged by a primary charger and is exposed imagewise with laser light modulated by a magenta image signal based on an original to form an electrostatic image on the photosensitive member, which is developed by using a magenta developing device containing a magenta toner to forma magenta toner image. The magenta toner image on the photosensitive member is then transferred to a transferred material conveyed thereto directly or indirectly via an intermediate transfer member.

The photosensitive member after developing of the electrostatic image and transfer of the toner image is charge-removed by a charge-removing charger, cleaned by a cleaning means and then again charged by the primary charger, followed by a similar process for formation of a cyan toner image and transfer of the cyan toner image onto the transfer material having received the magenta toner image. Further, similar development is performed with respect to yellow color and black color, thereby to transfer four-color toner images onto the transfer material. The transfer material carrying the four-color toner images is subjected to fixation under application of heat and pressure by a fixing means to form a full-color image.

In recent years, an image-forming apparatus performing an image forming method as described above not only is used as a business copier for simply reproducing an original but also has been used as a printer, typically a laser beam printer, for computer output and a personal copier for individual users.

In addition to such uses as representatively satisfied by a laser beam printer, the application of the basic image forming mechanism to a plain paper facsimile apparatus has been remarkably developed.

For such uses, the image forming apparatus has been required to be smaller in size and weight and satisfy higher speed, higher quality and higher reliability. Accordingly, the apparatus has been composed of simpler elements in various respects. As a result, the toner used therefor is required to show higher performances so that an excellent apparatus cannot be achieved without an improvement in toner performance. Further, in accordance with various needs for copying and printing, a greater demand is urged for color image formation, and a higher image quality and a higher resolution are required for faithfully reproducing an original color image. In view of these requirements, a toner used in such a color image forming method is required to exhibit good color-mixing characteristic on heating.

In the case of a fixing device for a color image forming apparatus, a plurality of toner layers including those of magenta toner, cyan toner, yellow toner and black toner, are formed on a transfer-receiving material, so that the offset is liable to be caused as a result of an increased toner layer thickness.

Hitherto, in order to prevent the attachment of a toner onto a fixing roller surface, it has been practiced to compose the roller surface of a material, such as a silicone rubber or a fluorine-containing resin, showing excellent releasability against a toner, and coat the roller surface with a film of a liquid showing a high releasability, such as silicone oil or a fluorine-containing oil, for the purpose of preventing offset and deterioration of the roller surface. However, such a measure, though very effective for preventing toner offset, requires an equipment for supplying the offset-preventing liquid and complicates the fixing device.

The transfer(-receiving) material carrying a toner image to be fixed by such a fixing device may generally comprise various types of paper, coated paper, and plastic film. In recent years, transparency films for an overhead projector (OHP films) have been frequently used for presentation, etc. An OHP film, unlike paper, has a low oil-absorption capacity and carries a substantial amount of oil on the OHP film after fixation. Silicone oil is liable to be evaporated on heat application to soil the interior of the apparatus and requires a necessity of treating the recovered oil. Accordingly, based on a concept of dispensing with a silicone oil applicator and supplying an offset-preventing liquid from the inside of the toner on heating, it has been practiced to add a release agent, such as low-molecular weight polyethylene or low-molecular weight polypropylene in the toner. However, in case where such a release agent is added in a large quantity so as to exhibit a sufficient effect, the release agent is liable to cause a filming onto the photosensitive member surface and soil the surface of a carrier or a developing sleeve, thus causing image deterioration. Accordingly, it has been practiced to incorporate in the toner a release agent in a small amount not causing image deterioration and supplying a small amount of a release oil or clean the toner attached onto the fixing roller by a winding-up type cleaning web or a cleaning pad.

However, in view of recent demand for a further smaller, lighter and more reliable apparatus, it is preferred to dispense with even such auxiliary means. Accordingly, the full-color image forming apparatus has also been desired to use a toner capable of meeting the above demand.

SUMMARY OF THE INVENTION

An object of the present invention is to provide a toner for developing electrostatic images having solved the above-mentioned problems.

Another object of the present invention is to provide a toner for developing electrostatic images showing excellent flowability and transferability.

Another object of the present invention is to provide a toner for developing electrostatic images having a good (triboelectric) chargeability and excellent developing characteristics (such as (triboelectric) chargeability and image density) and excellent transferability even after successive image formation of a large number of sheets.

Another object of the present invention is to provide a toner for developing electrostatic images having excellent low-temperature fixability and high-temperature anti-offset characteristic.

Another object of the present invention is to provide a toner for developing electrostatic images capable of providing a high-quality fixed image excellent in transparency on an OHP film.

Another object of the present invention is to provide a toner for developing electrostatic images which can be fixed well under heat and pressure without applying a release agent onto a roller.

According to the present invention, there is provided a toner for developing an electrostatic image, comprising toner particles wherein the toner particles comprise at least a binder resin, a colorant, a polar resin and a release agent;

wherein the polar resin has at least one terminal group which has been modified with a polycarboxylic acid having at least three carboxyl groups, the polar resin having an acid value of 3–35 mgKOH/g.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
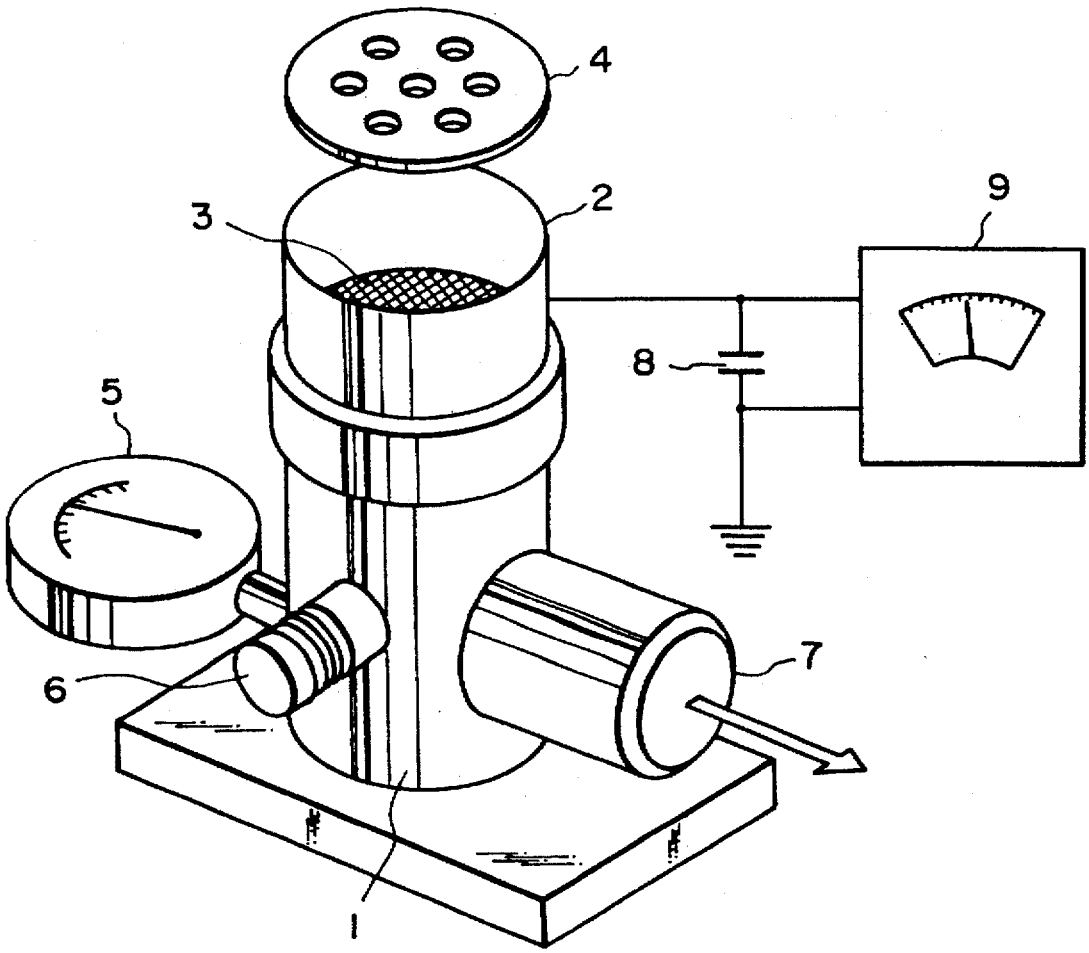
FIG. 1 is a schematic illustration of an apparatus for measuring the triboelectric charge of a toner.

In the toner for developing electrostatic images according to the present invention, a polar resin has at least one terminal group (portion) of its polymer chain which group has been modified (or connected) with a polycarboxylic acid having at least three carboxyl groups, so that the resultant polar resin has a larger number of carboxyl groups per one molecule of the polymer (polar resin) compared with a polar resin modified with a carboxylic acid having at most two carboxyl group. As a result, the toner is improved in low-temperature fixability, high-temperature anti-offset characteristic and triboelectric chargeability (charging characteristic).

The polar resin may particularly preferably comprise a polyester resin.

In case where toner particles are directly formed by dispersing a polymerizable monomer composition comprising at least a polymerizable monomer, a colorant, a polar resin, a release agent, and a polymerization initiator in an aqueous medium, forming the polymerizable monomer composition into particles, and polymerizing the polymerizable monomer; localization of the polar resin at the surface of the polymerizable monomer composition particles is further promoted. As a result, toner particles having a sharp particle size distribution can be obtained. Further, the release agent is well enclosed within the toner particle to effectively prevent or suppress localization (or presence) of the release agent at the toner particle surface, thus further improving a flowability of the toner.

The polycarboxylic acid having at least three carboxyl groups may preferably be tricarboxylic acid, particularly aromatic tricarboxylic acid, in view of purity, production stability and cost.

The polar resin may preferably have an acid value of 3–35 mgKOH/g, more preferably 4–35 mgKOH/g, further preferably 5–30 mgKOH/g.

If the polar resin has an acid value of below 3 mgKOH/g, the toner is liable to have a slow charging speed at an initial stage to cause fog. If the polar resin has an acid value exceeding 35 mgKOH/g, the toner is liable to change its triboelectric chargeability after being left standing in a high-temperature and high-humidity environment, thus being liable to change an image density during successive image formation. Further, in the case of the polar resin having an acid value exceeding 35 mgKOH/g, the polar resin has a high affinity between polymer molecules not to be readily dissolved in the polymerizable monomer, thus taking time to prepare a uniform polymerizable monomer composition.

The polar resin may preferably have a hydroxyl value (OH value) of 5–50 mgKOH/g, more preferably 7–45 mgKOH/g.

If the polar resin has an OH value of below 5 mgKOH/g, the polar resin is not readily localized at the particle surface of the polymerizable monomer composition in an aqueous medium compared with a polar resin having an OH value in the above-mentioned suitable range. If the polar resin has an OH value exceeding 50 mgKOH/g, the toner tends to somewhat lower its triboelectric chargeability after being left standing in a high-temperature/high-humidity environment, thus being liable to change an image density during successive image formation.

The polar resin may preferably have a weight-average molecular weight (Mw) of 6,000–50,000, more preferably 6,500–45,000.

If the polar resin has an Mw of below 6,000, external additive(s) present at the toner particle surface is liable to be embedded in the tone particle during successive image formation, thus being liable to invite a lowering in transferability compared with that having an Mw within the above range. If the polar resin has an Mw exceeding 50,000, it takes time to dissolve the polar resin in the polymerizable monomer. Further, the resultant polymerizable monomer composition is increased in viscosity not to readily provide toner particles having a small particle size and a sharp particle size distribution.

The polar resin may preferably have a number-average molecular weight (Mw) of 3,000–15,000, more preferably 3,500–12,000, and a main peak in molecular weight distribution according to gel permeation chromatography (GPC) (peak molecular weight (Mp)) in a molecular weight region of 4,500–22,000, more preferably 6,000–20,000.

If an Mn and Mp are out of the respective ranges described above, the difficulties are liable to arise similarly as in the case of Mw.

The polar resin may preferably have an Mw/Mn of 1.2–3.0, more preferably 1.5–2.5.

If the Mw/Mn is below 1.2, the toner is lowered in durability at the time of a large number of sheets of image formation and in anti-offset characteristic. If the Mw/Mn exceeds 3.0, a low-temperature fixability is somewhat lowered compared with a polar resin having an Mw/Mn within the above range.

In case where the polar resin is a polyester resin, the polyester resin may preferably have an acid value of 4–35 mgKOH/g and may preferably have a number-average molecular weight (Mn) of 3,000–15,000, a weight-average molecular weight (Mw) of 6,000–50,000, and an Mw/Mn of 1.2–3.0 based on GPC.

Further the polyester resin may preferably have an appropriate number-average molecular weight (Mw(cal.)) obtained from the following formula according to end-group analysis (method):

Mn(cal.)=56.108×2000/[(acid value of polyester resin)+(OH value of polyester resin)]. Specifically, an Mn (measured according to GPC) and an Mn(cal.) may preferably provide a difference therebetween [Mn−Mn (cal.)] of at least 500 because the resultant polyester resin has a polymer chain modified at a high modification degree.

The polar resin may preferably have a glass transition point (Tg) of 50°–95° C., more preferably 55°–90° C. Below 50° C., an anti-blocking characteristic of the toner is lowered. Above 95° C., the toner is lowered in low-temperature anti-offset characteristic.

A polar resin before the modification by the polycarboxylic acid (hereinbelow, sometimes referred to as "unmodified polar resin") may preferably have an acid value of 0.1–30 mgKOH/g, more preferably 1.0–28 mgKOH/g, and an OH value of 7–55 mgKOH/g, more preferably 10–50 mgKOH/g, respectively, in view of an improvement in an environmental stability of the toner.

The polar resin may preferably be used in an amount of 0.1–25 wt. parts, more preferably 0.5–20 wt. parts, further preferably 1–15 wt. parts, per 100 wt. parts of the binder resin or polymerizable monomer.

The acid value (mgKOH/g) of the polar resin (including unmodified and modified resins) may be determined in the following manner.

2–10 g of a sample resin is weighed in a 200 to 300 ml-Erlenmeyer flask, and about 50 ml of a methanol/toluene (=30/70) mixture solvent is added thereto to dissolve the resin. In case of poor solubility, a small amount of acetone may be added. The solution is titrated with an N/10 KOH/alcohol solution standardized in advance with the use of a 0.1 wt. % indicator mixture of bromothymol blue and Phenol Red. The acid value is calculated from the consumption of the KOH/alcohol solution based on the following equation:

Acid value = vol. (ml) of (KOH/alcohol) × $N$ × 56.1/sample weight, wherein N denotes the factor of the N/10 KOH/alcohol solution.

The hydroxyl value (OH value) of the polar resin may be determined in the following manner.

6 g of a sample resin (accurately weighed in mg unit) is weighed in a 200 ml-Erlenmeyer flask, and 5 ml of an acetic anhydride/pyridine (=¼) mixture solvent is added thereto by means of a whole pipet. To the mixture, 25 ml of pyridine is added by means of a measuring cylinder. Thereafter, a condenser (cooler) is attached to one of the necks of the Erlenmeyer flask and the mixture is reacted for 90 minutes at 100° C. on an oil bath. After the reaction, 3 ml of distilled water is added to the reaction mixture from the upper portion of the condenser. The mixture is sufficiently shaken and left standing for 10 minutes. The Erlenmeyer flask is pulled out of the oil bath while being equipped with the condenser and left standing for cooling. When the mixture is cooled to about 30° C., a small amount (about 10 ml) of acetone is added from the upper portion of the condenser so as to wash the condenser wall an the neck of the flask. To the mixture, 50 ml of tetrahydrofuran (THF) is added by a measuring cylinder. The resultant (mixture) liquid is subjected to neutralization titration with an N/2 KOH-THF solution with the use of a phenolphthalein indicator (alcohol solution) by means of a 50 ml-bullet (scale graduation mark: 0.1 ml). The titration is performed by adding 25 ml of neutral alcohol (methanol/acetone=1/1 by volume) to the liquid immediately before the neutralization end point and is continued until the resultant liquid assumes a pale carmine (or red). At the same time, a blank liquid is also subjected to the titration.

The OH value is obtained according to the following scheme:

OH value (mgKOH/g)=(B-A)×f×28.05/S+C, wherein A denotes an amount of the titrating liquid (N/2 KOH-THF solution) required for titrating the sample (ml); B denotes an amount of the titrating liquid required for titrating the blank (ml); f denotes a titer of the titration liquid; S denotes a sample weight (g); and C denotes an acid value.

The OH value is taken as an average value of the measured values.

The glass transition point (Tg) of the polar resin may be obtained by DSC measurement preferably by using a high-accuracy, internal-heating and input-compensation type DSC (differential scanning calorimeter) (e.g., "DSC-7", mfd. by Perkin-Elmer Corp.). The measurement may be performed according to ASTM D3418-82. A DSC curve may appropriately be taken in the courses of temperature raising at a temperature-raising rate of 10° C./min., after once heating and cooling a sample so as to remove the hysteresis.

The molecular weight (distribution) (Mw, Mn) of the polar resin may be measured based on a chromatogram obtained by GPC (gel permeation chromatography).

In the GPC apparatus, a column is stabilized in a heat chamber at 40° C., tetrahydrofuran (THF) solvent is caused to flow through the column at that temperature at a rate of 1 ml/min., and about 100 μl of a GPC sample solution adjusted at a prescribed concentration of 0.05–0.6 wt. % is injected. The identification of sample molecular weight and its molecular weight distribution is performed based on a calibration curve obtained by using several monodisperse polystyrene samples and having a logarithmic scale of molecular weight versus count number. The standard polystyrene samples for preparation of a calibration curve may be available from, e.g., Toso K.K. or Showa Denko K.K. It is appropriate to use at least 10 standard polystyrene samples inclusive of those having molecular weights of on the order of $10^2$–$10^7$. The detector may be an RI (refractive index) detector. For accurate measurement, it is appropriate to constitute the column as a combination of several commercially available polystyrene gel columns. A preferred example thereof may be a combination of Shodex GPC KF-801, 802, 803, 804, 805, 806, 807 and 800P available from Showa Denko K.K.; or a combination of TSK gel G1000H ($H_{XL}$), G2000H ($H_{XL}$), G3000H ($H_{XL}$), G4000H ($H_{XL}$), G5000H ($H_{XL}$), G6000H ($H_{XL}$), G7000H ($H_{XL}$), and TSK guard column available from Toso K.K.

A sample for measurement may be prepared as follows.

A sample is added in THF and left standing for several hours. After the standing, the mixture was sufficiently shaken until an aggregate or agglomeration disappears and is further left standing for at least 12 hours. In this case, the total standing time of the sample added in THF is set so as to be at least 24 hours. Thereafter, the mixture is filtrated with a sample-treating filter (pore size=0.45–0.5 μm; "MISHORIDISK H-25-5", md. by Toso K.K. or "EDICHRODISK 25CR", mfd. by German Science Japan Co.) to be subjected to a GPC sample. The sample is adjusted to have a resin component concentration of 0.5–5 mg/ml.

The unmodified polar resin (polar resin before the modification with the polycarboxylic acid) and the release agent may be prepared through processes including: one using oxidation reaction; synthesize from carboxylic acid and its derivative; one using ester group-introducing reaction represented by Mecheal addition reaction; one using dehydrocondensation reaction between a carboxylic acid compound an alcohol compound; one using a reaction of an acid halide compound with an alcohol compound; and one using transesterification reaction.

As a catalyst used for the above processes, an acid or alkaline catalyst generally used in esterification, such as zinc acetate or a titanium compound, may be used. The reaction product may be subjected to purification by recrystallization or distillation, as desired.

The unmodified polar resin and the release agent may preferably be prepared by using the dehydrocondensation reaction of a carboxylic acid compound and an alcohol compound in view of versatility of starting materials and ease of reaction.

The unmodified polar resin (polar resin before the modification) preferably used in the present invention may have a composition as described below.

The unmodified polar resin used in the present invention may preferably comprise 45–55 mol. % of alcohol component and 55–45 mol. % of acid component.

Examples of the alcohol component may include: diols, such as ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, bisphenol derivatives represented by the following formula (A):

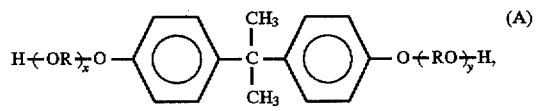

(A)

wherein R denotes an ethylene or propylene group, x and y are independently an integer of at least 1 with the proviso that the average of x+y is in the range of 2–10; and diols represented by the following formula (B):

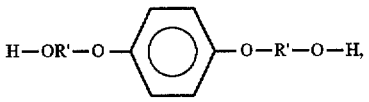

(B)

wherein R' denotes

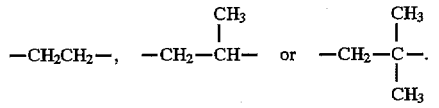

Examples of the dicarboxylic (dibasic) acid may include benzenedicarboxylic acids, such as phthalic acid, terephthalic acid, isophthalic acid, diphenyl-p,p'-dicarboxylic acid, naphthalene-2,7-dicarboxylic acid, naphthalene-2,6-dicarboxylic acid, diphenylmethane-p,p'-dicarboxylic acid, benzophenone-4,4'-dicarboxylic acid and 1,2-diphenoxyethane-p,p'-dicarboxylic acid, and their anhydrides; alkyldicarboxylic acids, such as succinic acid, adipic acid, sebacic acid, azelaic acid, glutaric acid and cyclohexanedicarboxylic acid, and their anhydrides; $C_6$–$C_{18}$ alkyl or alkenyl-substituted succinic acids, and their anhydrides; and unsaturated dicarboxylic acids, such as fumaric acid, maleic acid, citraconic acid and itaconic acid, and their anhydrides.

An especially preferred class of alcohol components constituting the polyester resin is a bisphenol derivative represented by the above formula (A), and preferred examples of acid components may include dicarboxylic acids inclusive of phthalic acid, terephthalic acid, isophthalic acid and their anhydrides; succinic acid, n-dodecenylsuccinic acid, and their anhydrides, fumaric acid, maleic acid, and maleic anhydride.

The unmodified polar resin may be synthesized from the dicarboxylic acid and diol as mentioned above. The polycarboxylic acids and polyols each having at least three functional groups may be added in a small amount not adversely affecting the resultant polar resin and the toner, as desired.

Examples of the polycarboxylic acid having three or more carboxylic groups may include: trimellitic acid, pyromellitic acid, cyclohexanetricarboxylic acids, 2,5,7-naphthalenetricarboxylic acid, 1,2,5-naphthalenetricarboxylic acid, 1,2,4-butanetricarboxylic acid, 1,2,5-hexanetricarboxylic acid, 1,3-dicarboxyl-2-methylenecarboxylpropane, 1,3-dicarboxyl-2-methyl-methylenecarboxylpropane, tetra(methylenecarboxyl) methane, 1,2,7,8-octanetetracarboxylic acid, and their anhydrides.

Examples of the polyols having three or more hydroxyl groups may include: sorbitol, 1,2,3,6-hexanetetraol, 1,4-sorbitan, pentaerythritol, dipentaerythritol, tripentaerythritol, sucrose, 1,2,4-butanetriol, glycerin, 2-methylpropanetriol, trimethylolethane, trimethylolpropane, and 1,3,5-trihydroxymethylbenzene.

The unmodified polar resin may preferably have a mixing ratio of alcohol component (OH component) to carboxylic acid component (COOH component) satisfying the following relationship:

$$1 \leqq (\text{OH component})/(\text{COOH component}) < 1.8, \text{ more preferably}$$

$$1 \leqq (\text{OH component})/(\text{COOH component}) < 1.3.$$

If the mixing ratio is below 1, a yet unreacted carboxylic acid component is liable to remain even after the modification (with the polycarboxylic acid). In this case, when toner particles are produced through the polymerization method, the resultant toner particles are liable to have a broad particle size distribution under the influence of the yet un-reacted carboxylic acid component. If the mixing ratio is at least 1.8, a yet un-reacted alcohol component remains, thus resulting in an polyester (polar) resin having a low purity. As a result, the resultant toner is liable to change its triboelectric chargeability.

The unmodified polar resin may have physical properties (e.g., Tg, Mw, Mn, Mw/Mn) substantially identical to those of the resultant (modified) polar resin described above.

The unmodified polar resin may, e.g., be modified in the following manner.

A once-produced unmodified polar resin is modified by reaction (for bonding) of yet-unreacted hydroxyl groups with the above-mentioned polycarboxylic acid having at least three carboxyl groups (modifier) in the presence of a catalyst, such as calcium phosphate, ferric chloride, zinc chloride, organometallic salt of tin or titanium, or tin oxide, at a temperature of 150°–270° C. under a reduced pressure or under azeotropic distillation using a solvent, while removing the resultant water, thereby obtaining a modified polar (polyester) resin.

The unmodified polar resin may be modified at 60°–200° C. by using a solvent and diisocyanate.

The confirmation of the modification may, e.g., be performed by an increased acid value of the modified polar resin (after modification) in comparison with that of the unmodified polar resin (before modification).

The acid value of the modified polar resin may preferably be larger that of the unmodified polar resin by at least 2.0 mgKOH/g, more preferably at least 4.0 mgKOH/g.

The release agent used in the toner of the present invention may preferably have an Mw of 350–4,000, more preferably 400–3,500, an Mn of 200–4,000, more preferably 250–3,500.

If the Mw is below 350 and the Mn is below 200, the resultant toner is lowered in anti-blocking characteristic. If the Mw exceeds 4,000 and the Mn exceeds 4,000, the release agent per se exhibits crystallinity to lower a transparency of a fixed image.

The molecular weight (distribution) of the release agent may be measured by GPC under the following conditions:

Apparatus: "GPC-150C" (available from Waters Co.)

Column: "GMH-HT" 30 cm-binary (available from Toso K.K.)

Temperature: 135° C.

Solvent: o-dichlorobenzene containing 0.1% of ionol.

Flow rate: 1.0 ml/min.

Sample: 0.4 ml of a 0.15% -sample.

Based on the above GPC measurement, the molecular weight distribution of a sample is obtained once based on a calibration curve prepared by monodisperse polystyrene standard samples, and recalculated into a distribution corresponding to that of polyethylene using a conversion formula based on the Mark-Houwink viscosity formula.

The release agent may preferably have a melting point (a temperature corresponding to a maximum heat-absorption peak on a DSC curve in a temperature range of 20°–200° C.) of 30°–120° C., more preferably 50°–90° C.

The release agent may preferably be a solid wax showing a solid state at room temperature, particularly preferably be a solid was having a melting point of 50°–90° C. in terms of toner performances including anti-blocking characteristic, durability at successive image formation, low-temperature fixability and anti-offset characteristic.

Examples of the wax may include: paraffin wax, polyolefin wax, microcrystalline wax, polymethylene wax such as Fischer-Tropshe wax, amide wax, higher aliphatic acid, long-chain alcohol, ester wax, and derivatives thereof such as grafted products and block compounds. It is preferred to remove a low-molecular weight fraction from the wax to provide a DSC heat absorption curve having a sharp maximum heat-absorption peak.

Preferred examples of the wax (release agent) may include: linear alkyl alcohols, linear aliphatic acids, linear acid amides, linear esters and montane derivatives each having 15–100 carbon atoms. It is also preferred to remove impurities, such as liquid aliphatic acid from the waxes in advance.

A preferred class of the wax used in the present invention may include a low-molecular weight alkylene polymer wax obtained through polymerization of an alkylene by radical polymerization under a high pressure or in the presence of a Ziegler catalyst under a low pressure; an alkylene polymer obtained by thermal decomposition of an alkylene polymer of a high molecular weight; a fractionation product obtained by fractionating a low-molecular alkylene polymer by-produced in alkylene polymerization, and a polymethylene wax obtained by removing a distribution residue from the Arge process for converting a gas mixture of carbon monoxide and hydrogen to form a hydrocarbon polymer and extracting a particular fraction from the distillation residue as it is or after hydrogenation. These waxes may contain an antioxidant added thereto.

In order to improve a light-transmission characteristic of a fixed image, the relates agent may preferably be a solid water wax. The release agent may particularly preferably be a solid ester wax having a melting point of 50°–90° C.

The release agent may also preferably comprise an ester wax selected from the group consisting of compounds represented by the following formulae (I)–(VI):

$$[R_1—COO—(CH_2)_n]_a—C—[(CH_2)_m—OCO—R_2]_b \quad (I),$$

wherein a and b independently denote an integer of 0–4 satisfying a+b=4; $R_1$ and $R_2$ independently denote an organic group having 1–40 carbon atoms, $R_1$ and $R_2$ providing a difference in carbon number of at least 3; and m and n independently denote an integer of 0–25 with the proviso that m and n are not 0 at the same time;

$$[R_1—COO—(CH_2)_n]_a—\overset{(R_3)_k}{\overset{|}{C}}—[(CH_2)_m—OCO—R_2]_b, \quad (II)$$

wherein a and b independently denote an integer of 0–3 satisfying a+b=1–3; $R_1$ and $R_2$ independently denote an organic group having 1–40 carbon atoms, $R_1$ and $R_2$ providing a difference in carbon number of at least 3; $R_3$ denotes hydrogen atom or an organic group having at least one carbon atom with the proviso that one of $R_3$ is an organic group having at least one carbon atom when a+b=2; k is an integer of 1–3; and m and n independently denote an integer of —25 with the proviso that m and n are not 0 at the same time;

$$R_1—OCO—R_2—COO—R_3 \quad (III),$$

wherein $R_1$ and $R_3$ independently denote an organic group having 6–32 carbon atoms, and $R_2$ denotes an organic group having 1–20 carbon atoms;

$$R_1—COO—R_2—OCO—R_3 \quad (IV),$$

wherein $R_1$ and $R_3$ independently denote an organic group having 6–32 carbon atoms; and $R_2$ denotes $—CH_2CH_2OC_6H_4OCH_2CH_2—$, $—(CH(CH_3)CH_2O)_m—C_6H_4C(CH_3)_2C_6H_4—(OCH_2CH(CH_3))_m—$ or $—(CH_2)_n—$ wherein m is an integer of 1–10 and n is an integer of 1–20;

$$[R_1—COO—(CH_2)_n]_a—C—[(CH_2)_m—OH]_b \quad (V),$$

wherein a is an integer of 0–4 and b is an integer of 1–4 satisfying a+b=4; $R_1$ denotes an organic group having 1–40 carbon atoms; and m and n independently denote an integer of 0–25 with the proviso that m and n are not 0 at the same time; and $$R_1—COO—R_2 \quad (VI),$$

wherein $R_1$ and $R_2$ independently denote a hydrocarbon group having 15–45 carbon atoms.

Specific examples of the ester wax comprising an ester compound as the release agent may include those shown below.

Release agent No. 1

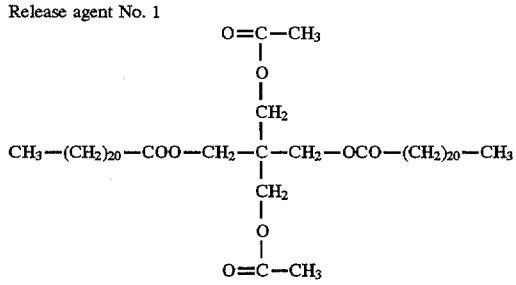

Release agent No. 2

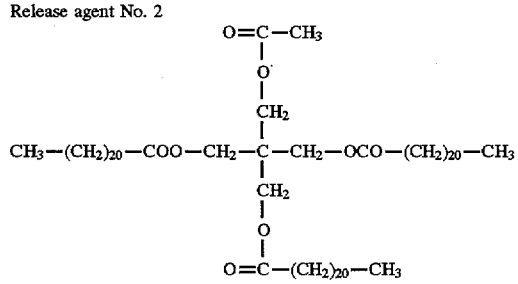

Release agent No. 3

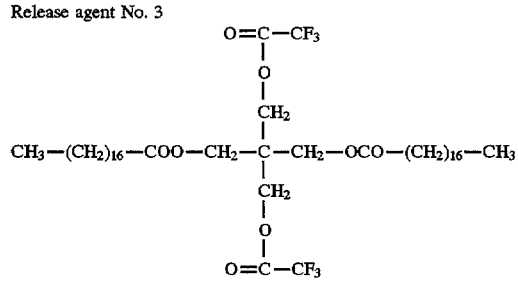

Release agent No. 4

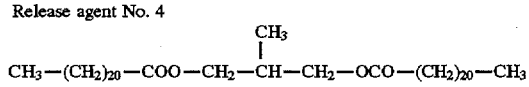

Release agent No. 5
$CH_3(CH_2)_{20}COO(CH_2)_{21}CH_3$

Release agent No. 6
$CH_3(CH_2)_{16}COO(CH_2)_{21}CH_3$

Release agent No. 7
$CH_3(CH_2)_{39}COO(CH_2)_{17}CH_3$

Release agent No. 8
$CH_3(CH_2)_{20}COO(CH_2)_{17}CH_3$

-continued

Release agent No. 9

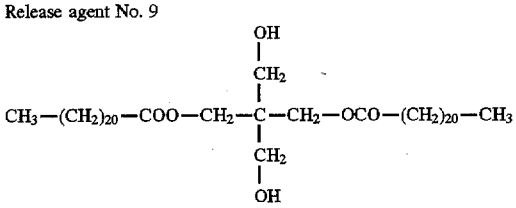

Release agent No. 10

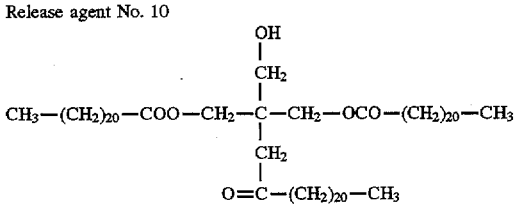

Release agent No. 11

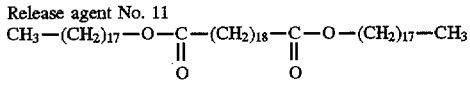

Release agent No. 12

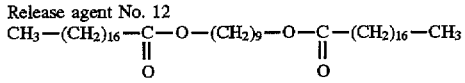

In case where the release agent comprises an ester wax comprising an ester compound represented by the above structural formulae (Release agents Nos. 1–12), the ester wax exhibits a good transparency and provides a toner with a good fixability when incorporated in toner particles. After the release agent an the modified polar resin are dissolved in a polymerizable monomer, the polymerizable monomer is polymerized in an aqueous medium to obtain a toner for developing electrostatic image including toner particles excellent in charge amount and providing a larger charging speed up to arrival at a moderate charging level and less fluctuation in triboelectric chargeability during successive image formation of a large number of sheets.

In case where toner particles are produced by a pulverization method including a melt-kneading step, the release agent may preferably be used in an amount of 0.5–10 wt. parts per 100 wt. parts of the binder resin.

In case where toner particles are directly produced by the monomer composition in an aqueous medium (e.g., water), the release agent may preferably be used in an amount of 5–40 wt. parts, more preferably 10–30 wt. parts, per 100 wt. parts of the polymerizable monomer. As a result, the release agent may preferably be incorporated in toner particles in an amount of 5–40 wt. parts, more preferably 10–30 wt. parts, per 100 wt. parts of the binder resin resulting from the polymerizable monomer.

According to the toner production method using the polymerization method, compared with the dry toner production method using the pulverization method, a large amount of the release agent is liable to be encapsulated or enclosed within toner particles by the modified polar resin to generally allow the use of a large amount of the release agent. As a result, the toner production method using the polymerization method is particularly effective in preventing offset at the time of fixation.

If the release agent is used in an amount of below the respective lower limits of the above ranges, an offset prevention effect is liable to be lowered. If the release agent is used in an amount exceeding the respective upper limits of the above ranges, an anti-blocking effect is liable to be lowered to adversely affect an anti-offset effect, thus being liable to cause toner (melt)-sticking onto a photosensitive drum and/or a developing sleeve. Further, in the case of using the polymerization method for forming toner particles, toner particles having a broad particle size distribution are liable to be formed.

The release agent used in the present invention may preferably have a soluble parameter (SP value) in the range of 7.6–10.5. A release agent having an SP value of below 7.6 shows a poor compatibility (mutual solubility) with the polymerizable monomer binder resin, so that it is difficult to obtain a good dispersion state within the binder resin. As a result, the release agent is liable to attach onto the developing sleeve and cause a change in triboelectric chargeability of the toner during a large number of successive image formation (copying or printing). Further, ground fog and density change at the time of toner replenishment are also liable to occur. If a release agent having an SP value in excess of 10.5 is used, the resultant toner particles are liable to cause blocking during a long term of storage. Further, as such a release agent shows excessively good compatibility with the binder resin, it is difficult to form a sufficient release layer between the fixing member and the toner binder resin layer at the time of fixation, so that offset phenomenon is liable to occur.

The solubility parameter (SP value) may for example be calculated based on the Fedors' method (Polym. Eng. Sci., 14(2) 147 (1974)) utilizing the additivity of atomic groups.

The melt viscosity at 135° C. of the release agent used in the present invention may preferably be 1–300 cps, further preferably 3–50 cps. If the melt viscosity is below 1 cp, when the resultant toner is used in a non-magnetic one-component development system and applied by an application blade, etc., onto a developing sleeve to form a thin toner layer thereon, the toner is liable to soil the sleeve due to a mechanical shearing force. Also in the two-component development system using carrier particles together with a toner for developing an electrostatic image, the toner is liable to be damaged by a shearing force acting between the toner and the carrier particles, whereby the embedding of an external additive and breakage of the toner are liable to occur. If the melt viscosity exceeds 300 cps, it is difficult to obtain minute toner particles having a sharp particle size distribution because of a high viscosity of the polymerizable monomer composition in case of toner production through the polymerization process.

The melt viscosity may for example be measured at 135° C. by using, e.g., "VP-500" (available from HAAKE Co.) equipped with a cone plate-type rotor ("PK-1").

The release agent used in the present invention may preferably have a Vickers hardness in the range of 0.3–5.0, further preferably 0.5–3.0.

A toner containing a release agent having a Vickers hardness of below 0.3 is liable to be broken in the cleaning step and cause toner sticking onto the photosensitive drum surface, thus being liable to provide black streaks in the resultant images, during a large number of successive image formation. Further, when a plurality of fixed image samples are stacked together and stored, back transfer, i.e., the transfer of the toner onto the back, being liable to occur. A toner containing release agent having a Vickers hardness in excess of 5.0, requires an excessively high pressure by a fixing device at the time of hot-pressure fixation and thus requiring a fixing device designed to have a large mechanical strength. When such a toner is used in a fixing device of an ordinary pressure, it is liable to show a poor anti-offset characteristic.

The hardness of the release agent may be measured by using, e.g., a dynamic ultra-minute hardness meter ("DUH- 200", available from Shimazu Seisakusho K.K.) in the following manner. A release agent is melted and molded into a 5 mm-thick cylindrical pellet in a 20 mm dia-mold. The sample is pressed by a Vickers pressure element at a load of 0.5 g and a loading rate of 9.67 mg/sec to cause a displacement of 10 μm, followed by holding for 12 sec. Then, the pressed mark on the sample is analyzed to measure a Vickers hardness.

The binder resin for the toner of the present invention may for example comprise: polystyrene; homopolymers of styrene derivatives, such as poly-p-chlorostyrene and polyvinyltoluene; styrene copolymers such as styrene-p-chlorostyrene copolymer, styrene-vinyltoluene copolymer, styrene-vinylnaphthalene copolymer, styrene-acrylate copolymer, styrene-methacrylate copolymer, styrene-methyl-α-chloromethacrylate copolymer, styrene-acrylonitrile copolymer, styrene-vinyl methyl ether copolymer, styrene-vinyl ethyl ether copolymer, styrene-vinyl methyl ketone copolymer, styrene-butadiene copolymer, styrene-isoprene copolymer and styrene-acrylonitrile-indene copolymer; acrylic resin, methacrylic resin, polyvinyl acetate, silicone resin, polyester resin, polyamide resin, furan resin, epoxy resin and xylene resin. These resins may be used singly or in combination of two or more species.

As a principal component of the binder resin, it is preferred to use a styrene copolymer which is a copolymer of styrene and another vinyl monomer, in view of the developing and fixing performances.

Examples of the comonomer constituting such a styrene copolymer together with styrene monomer may include other vinyl monomers inclusive of: monocarboxylic acids having a double bond and derivative thereof, such as acrylic acid, methyl acrylate, ethyl acrylate, butyl acrylate, dodecyl acrylate, octyl acrylate, 2-ethylhexyl acrylate, phenyl acrylate, methacrylic acid, methyl methacrylate, ethyl methacrylate, butyl methacrylate, octyl methacrylate, acrylonitrile, methacrylonitrile, and acrylamide; dicarboxylic acids having a double bond and derivatives thereof, such as maleic acid, butyl maleate, methyl maleate and dimethyl maleate; vinyl esters, such as vinyl chloride, vinyl acetate, and vinyl benzoate; ethylenic olefins, such as ethylene, propylene and butylene; vinyl ketones, such as vinyl methyl ketone and vinyl hexyl ketone; and vinyl ethers, such as vinyl methyl ether, vinyl ethyl ether, and vinyl isobutyl ether. These vinyl monomers may be used alone or in mixture of two or more species in combination with the styrene monomer.

It is preferred that the styrene copolymer is crosslinked with a crosslinking agent, such as divinylbenzene, in order to provide the resultant toner with a broader fixable temperature region and an improved anti-offset characteristic.

The crosslinking agent may principally be a compound having two or more double bonds susceptible of polymerization, examples of which may include: aromatic divinyl compounds, such as divinylbenzene, and divinylnaphthalene; carboxylic acid esters having two double bonds, such as ethylene glycol diacrylate, ethylene glycol dimethacrylate and 1,3-butanediol dimethacrylate; divinyl compounds, such as divinylanilene, divinyl ether, divinyl sulfide and divinylsulfone; and compounds having three or more vinyl groups. These may be used singly or in mixture.

In the case of using a binder resin comprising principally a crosslinked styrene copolymer, the binder resin may preferably contain a THF-soluble component providing a molecular weight distribution according to gel permeation chromatograph (GPC) showing a main peak in a molecular weight region of $3\times10^3$–$5\times10^4$ and a sub-peak or shoulder in a molecular weight region of at least $10^5$. The binder resin comprising principally a styrene copolymer may preferably contain a toluene-insoluble content of 0.1–20 wt. %, preferably 1–15 wt. %.

The toluene-insoluble content refers to a weight percentage of an ultra high-molecular weight polymer component (substantially a crosslinked polymer) insoluble in solvent toluene The toluene-insoluble content referred to herein is based on values measured in the following manner.

0.5–1.0 g of a toner sample is weighed (at $W_1$ g) and placed in a cylindrical filter paper (e.g., "No. 86R", available from Toyo Roshi K.K.), which is mounted on a Soxhlet's extractor. Then, the sample is subjected to 12 hours of extraction with 100–200 ml of solvent toluene, and the soluble content extracted with toluene is subjected to evaporation of toluene and dried under vacuum for several hours at 100° C. to be weighed (at $W_2$ g). Based on the measured values and the weight ($W_3$ g) of the components, such as the pigment and the wax, other than the resin component, the toluene-insoluble content is calculated by the following equation:

$$\text{Toluene-insoluble content (wt. \%)}=\{[W_1-(W_3+W_2)]/(W_1-W_3)\}\times 100$$

In the case of a binder resin comprising a polyester resin, the binder resin may preferably have such a molecular weight distribution that it shows at least one peak in a molecular weight region of $3\times10^3$–$5\times10^4$ and contains 60–100 wt. % of a component having a molecular weight of at most $10^5$. It is further preferred that at least one peak is present in a molecular weight region of $5\times10^3$–$3\times10^4$.

Examples of the black colorant used in the present invention may include: carbon black, a magnetic material, and a colorant showing black by color-mixing of yellow/magenta/cyan colorants as shown below.

Examples of the yellow colorant may include: condensed azo compounds, isoindolinone compounds, anthraquinone compounds, azo metal complexes, methin compounds and arylamide compounds. Specific preferred examples thereof may include C.I. Pigment Yellow 12, 13, 14, 15, 17, 62, 74, 83, 93, 94, 95, 109, 110, 111, 128, 129, 147, 168 and 180.

Examples of the magenta colorant may include: condensed azo compounds, diketopyrrolepyrrole compounds, anthraquinone compounds, quinacridone compounds, basic dye lake compounds, naphthol compounds, benzimidazole compounds, thioindigo compounds and perylene compounds. Specific preferred examples thereof may include: C.I. Pigment Red 2, 3, 5, 6, 7, 23, 48:2, 48:3, 48:4, 57:1, 81:1, 122, 146, 166, 169, 177, 184, 185, 202, 206, 220, 221 and 254.

Examples of the cyan colorant may include: copper phthalocyanine compounds and their derivatives, anthraquinone compounds and basic dye lake compounds. Specific preferred examples thereof may include: C.I. Pigment Blue 1, 7, 15, 15:1, 15:2, 15:3, 15:4, 60, 62, and 66.

These colorants may be used singly, in mixture of two or more species or in a state of solid solution. The above colorants may be appropriately selected in view of hue, color saturation, color value, weather resistance, OHP transparency, and a dispersibility in toner particles. The above colorants may preferably be used in a proportion of 1–20 wt. parts per 100 wt. parts of the binder resin.

The toner according to the present invention can be constituted as a magnetic toner by containing a magnetic material, which may also function as a colorant. Examples of the magnetic material used in the magnetic toner in the present invention may include: iron oxides, such as magnetite, hematite, and ferrite; metals, such as iron, cobalt and nickel, and alloys of these metals with other metals, such as aluminum, cobalt, copper, lead, magnesium, tin, zinc, antimony, beryllium, bismuth, cadmium, calcium, manganese, selenium, titanium, tungsten, and vanadium; and mixture of the above.

The magnetic material usable in the present invention may preferably be a surface-treated (modified) magnetic material. In the case of the polymerization toner, the magnetic material may preferably be surface-treated with a surface-treating agent not impairing polymerization reaction to effect a hydrophobicity-imparting treatment. Examples of such a surface-treating agent may, e.g., include a silane coupling agent and a titanium coupling agent.

The magnetic material may preferably have an average particle size of at most 2 μm, more preferably 0.1–5 μm, and may preferably used in an amount of 20–200 wt. parts, more preferably 40–150 wt. parts, per 100 wt. parts of the binder resin. The magnetic material may preferably show magnetic properties including a coercive force (Hc) of 20–300 Oersted, a saturation magnetization ($\sigma_s$) of 50–200 emu/g, and a residual magnetization ($\sigma_r$) of 2–20 emu/g under application of a magnetic field of 10K Oersted.

The toner according to the present invention can further contain a negative or positive charge control agent.

Examples of the negative charge control agent may include: organic metal complexes and chelate compounds inclusive of monoazo metal complexes acetylacetone metal complexes, and organometal complexes of aromatic hydroxycarboxylic acids and aromatic dicarboxylic acids. Other examples may include: aromatic hydroxycarboxylic acids, aromatic mono- and poly-carboxylic acids, and their metal salts, anhydrides and esters, and phenol derivatives, such as bisphenols.

Further examples may include: urea derivative, metal-containing salicylic acid-based compounds, quaternary ammonium salts, and calixarene.

Examples of the positive charge control agents may include: nigrosine and modified products thereof with aliphatic acid metal salts, etc.; guanidine compounds; imidazole compounds; onium salts inclusive of quaternary ammonium salts, such as tributylbenzylammonium 1-hydroxy-4-naphtholsulfonate and tetrabutylammonium tetrafluoroborate, and their homologous inclusive of phosphonium salts, and lake pigments thereof; triphenylmethane dyes and lake pigments thereof (the laking agents including, e.g., phosphotungstic acid, phosphomolybdic acid, phosphotungsticmolybdic acid, tannic acid, lauric acid, gallic acid, ferricyanates, and ferrocyanates); higher aliphatic acid metal salts; diorganotin oxides, such as dibutyltin oxide, dioctyltin oxide and dicyclohexyltin oxide; and diorganotin borates, such as dibutyltin borate, dioctyltin borate and dicyclohexyltin borate. These may be used singly or in mixture of two or more species.

Among these, negative and positive charge control agents, metal-containing salicylic acid-based compounds may preferably be used in combination with the polar resin (preferably polyester resin).

These charge control agents may preferably be used in a proportion of 0.01–20 wt. parts, more preferably 0.5–10 wt. parts, per 100 wt. parts of the resin component.

The toner may further contain an additive which may be added in order to improve various characteristics of the toner. Such an additive may preferably be in the form of particles having a particle size which is at most ⅕ of the volume-average particle size of the toner particles in view of its durability. The average particle size of an additive refers to an average particle size obtained by observation of surface states of toner particles through an electron microscope. Examples of the additive may include the following.

Flowability imparting agents, such as metal oxides inclusive of silicon oxide, aluminum oxide and titanium oxide, carbon black, and fluorinated carbon. These materials may preferably be subjected to a hydrophobicity-imparting treatment.

Abrasives, inclusive of: metal oxides such as strontium titanate, cerium oxide, aluminum oxide, magnesium oxide, and chromium oxide; nitrides, such as silicon nitride; carbide, such as silicon carbide; and metal salts, such as calcium sulfate, barium sulfate and calcium carbonate.

Lubricants, inclusive of: powder of fluorine-containing resins, such as polyvinylidene fluoride, and polytetrafluoroethylene; and aliphatic acid metal salts, such as zinc stearate, and calcium stearate.

Charge-controlling particles, inclusive of: particles of metal oxides, such as tin oxide, titanium oxide, zinc oxide, silicon oxide, and aluminum oxide, and carbon black.

These additives may be added in a proportion of 0.1–10 wt. parts, preferably 0.1–5 wt. parts, per 100 wt. parts of the toner particles. These additives may be used singly or in combination of plural species.

The toner according to the present invention may preferably show an agglomeratability of 1–30%, more preferably 4–20%, in view of the developing performance. A lower agglomeratability represents a higher flowability of toner. Further, a higher agglomeratability represents a lower flowability of toner.

The agglomeratability of the toner may be measured in the following manner.

The agglomeratability of a sample toner is measured by using a powder tester (available from Hosokawa Micron K.K.). On a vibration table, a 400 mesh-sieve, a 200 mesh-sieve and a 100 mesh-sieve are set in superposition in this order, i.e., so that the 100-mesh sieve having the largest opening is placed at the uppermost position. On the set sieves, 5 g of a sample toner is placed, and the sieves are vibrated for 25 sec at an input voltage to the vibration table of 15 volts while controlling an amplitude (vibration width) so as to be in the range of 60–90 μm. Then, the weights of the toner remaining on the respective sieves are measured to calculate the agglomeratability according to the following formula:

$$\text{Agglomeratability } (\%)=(a/5+(b/5)\times 0.6+(c/5)\times 0.2)\times 100, \text{ wherein}$$

a: weight of toner on 100 mesh-sieve (g)

b: weight of toner on 200 mesh-sieve (g)

c: weight of toner on 400 mesh-sieve (g).

As a process for producing a toner according to the present invention, there may be adopted a pulverization process wherein the binder resin, the colorant, the polar resin, the release agent and other optional additives such as a charge control agent and other internal additives are uniformly kneaded and dispersed by a pressure kneader, an extruder or a media disperser, and the kneaded product is mechanically pulverized or caused to impinge onto a target in a jet stream to be pulverized into a desired toner particle size level, followed by classification into a narrower particle size distribution to form toner particles. In addition, it is also possible to adopt a process for directly producing toner particles according to suspension polymerization as disclosed in JP-B 36-10231, JP-A 59-53856, and JP-A 59-61842; a boundary association process wherein fine particles of at least one species are agglomerated into a desired particle size as disclosed in JP-A 6-106473 and JP-A 63-186253; a dispersion polymerization process for directly producing toner particles in an aqueous organic solvent in which the monomer is soluble but the resultant polymer is insoluble; and a process for producing toner particles according to emulsion polymerization as represented by soap-free polymerization wherein toner particles are directly formed by polymerization in the presence of a water-soluble polymerization initiator.

In the polymerization process for toner particle production, it is preferred to incorporate in a polymerizable monomer a colorant and a polar resin, and also a release agent and a polymerization initiator; form the resultant polymerizable monomer composition into particles; and polymerize the particles of the composition, to form polymerizate particles (toner particles) in which the release agent is enclosed within the polar resin and the polymerized binder in a sea-island structure.

Such a sea-island structure in which the release agent is enclosed within the polar resin and the binder resin may suitably be provided by dispersing in an aqueous medium a polymerizable monomer composition obtained by mixing a principal monomer, a release agent having a lower polarity than the principal monomer and a polar resin to provide a core-shell structure wherein the release agent is coated with the polar resin and the resultant binder resin. The resultant polyermizable particles may be used as toner particles as they are or after association of very fine particles up to a desired particle size to provide toner particles having a sea-island structure.

By enclosing the release agent in toner particles well, a relatively large amount of the release agent can be incorporated within toner particles while suppressing the lowering in anti-blocking performance. Further, by using a solid wax having a melting point of 50°–90° C. as a release agent, it is possible to provide toner particles having a high mechanical impact strength and yet capable of showing a low-temperature fixability and good color mixing performance at the time of heat-pressure fixation.

The polymerizable monomer suitably used for producing toner particles according to the polymerization process may suitably be a vinyl-type polymerizable monomer capable of radical polymerization. The vinyl-type polymerizable monomer may be a monofunctional monomer or a polyfunctional monomer. Examples of the monofunctional monomer may include: styrene; styrene derivatives, such as α-methylstyrene, β-methylstyrene, o-methylstyrene, m-methylstyrene, p-methylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, and p-phenylstyrene; acrylic monomers, such as methyl acrylate, ethyl acrylate, n-propyl acrylate, isopropyl acrylate, n-butyl acrylate, isobutyl acrylate, tertbutyl acrylate, n-amyl acrylate, n-hexyl acrylate, 2-ethylhexyl acrylate, n-octyl acrylate, n-nonyl acrylate, cyclohexyl acrylate, benzyl acrylate, dimethylphosphateethyl acrylate, diethylphosphateethyl acrylate, dibutylphosphateethyl acrylate, and 2-benzoyloxyethyl acrylate; methacrylic monomers, such as methyl methacrylate, ethyl methacrylate, n-propyl methacrylate, iso-propyl methacrylate, n-butylmethacrylate, iso-butyl methacrylate, tert-butyl methacrylate, n-amyl methacrylate, n-hexyl methacrylate, 2-ethylhexyl methacrylate, n-octyl methacrylate, n-nonyl methacrylate, diethylphosphateethyl methacrylate, and dibutylphosphateethyl methacrylate; methylene aliphatic monocarboxylic acid esters; vinyl esters, such as vinyl acetate, vinyl propionate, vinyl benzoate, vinyl lactate, and vinyl formate; vinyl ethers, such as vinyl methyl ether, vinyl ethyl ether, and vinyl isobutyl ether; and vinyl ketones, such as vinyl methyl ketone, vinyl hexyl ketone, and vinyl isopropyl ketone.

Examples of the polyfunctional monomer may include: diethylene glycol diacrylate, triethylene glycol diacrylate, tetraethylene glycol diacrylate, polyethylene glycol diacrylate, 1,6-hexanediol diacrylate, neopentyl glycol diacrylate, tripropylene glycol diacrylate, polypropylene glycol diacrylate, 2,2'-bis[4-acryloxydiethoxy)phenyl] propane, trimethylpropane triacrylate, tetramethylmethane tetraacrylate, ethylene glycol dimethacrylate, diethylene glycol dimethacrylate, triethylene glycol dimethacrylate, tetraethylene glycol dimethacrylate, polyethylene glycol dimethacrylate, 1,3-butylene glycol dimethacrylate, 1,6-hexanediol dimethacrylate, neopentyl glycol dimethacrylate, polypropylene glycol dimethacrylate, 2,2'-bis[4-(methacryloxydiethoxy)phenyl]propane, 2,2'-bis[4-(methacryloxypolyethoxy)phenyl]propane, trimethylpropane trimethacrylate, tetramethylmethane tetramethacrylate, divinylbenzene, divinylnaphthalene, and divinyl ether.

In the present invention, the above-mentioned monofunctional monomer may be used singly or in combination of two or more species thereof, or optionally in combination with one or more species of the polyfunctional polymerizable monomer. The polyfunctional polymerizable monomer may also be used as a crosslinking agent.

The polymerization initiator used for polymerization of the above-mentioned polymerizable monomer may be an oil-soluble initiator and/or a water-soluble initiator. Examples of the oil-soluble initiator may include: azo compounds, such as 2,2'-azobisisobutyronitrile, 2,2'-azobis-2,4-dimethylvaleronitrile, 1,1'-azobis(cyclohexane-1-carbonitrile), and 2,2'-azobis-4-methoxy-2,4-dimethylvaleronitrile; and peroxide initiators, such as acetylcyclohexylsulfonyl peroxide, diisopropyl peroxycarbonate, decanoyl peroxide, lauroyl peroxide, stearoyl peroxide, propionyl peroxide, acetyl peroxide, t-butyl peroxy-2-ethylhexanoate, benzoyl peroxide, t-butyl peroxyisobutyrate, cyclohexanone peroxide, methyl ethyl ketone peroxide, dicumyl peroxide, t-butyl hydroperoxide, di-t-butyl peroxide, and cumeme hydroperoxide.

Examples of the water-soluble initiator may include: ammonium persulfate, potassium persulfate, 2,2'-azobis(N,N'-dimethyleneisobutyroamidine)hydrochloric acid salt, 2,2'-azobis(2-amidinopropane)hydrochloric acid salt, azobis(isobutylamidine)hydrochloric acid salt, sodium 2,2'-azobisisobutyronitrilesulfonate, ferrous sulfate and hydrogen peroxide.

In the present invention, it is possible to further add a chain transfer agent, a polymerization inhibitor, etc., in order to control the degree of polymerization of the polymerizable monomer.

The toner according to the present invention may particularly preferably be produced through the suspension polymerization process by which a particulate toner having a coefficiency of variation in number of 35% or below (preferably 30% or below) and a small particle size of 3–8 μm (weight-average particle size $D_4$) can be easily produced with a uniformly controlled shape and a sharp particle size distribution. It is also possible to suitably apply the seed polymerization process wherein once-obtained polymerizate particles are caused to adsorb a monomer, which is further polymerized in the presence of a polymerization initiator. It is also possible to include a polar compound in the monomer adsorbed by dispersion or dissolution.

In case where the toner according to the present invention is produced through the suspension polymerization, toner particles may be produced directly in the following manner. Into a polymerizable monomer, a release agent such as wax, a colorant, a polar resin, a polymerization initiator, a crosslinking agent and another optional additive are added and uniformly dissolved or dispersed by a homogenizer or an ultrasonic dispersing device, to form a polymerizable monomer composition, which is then dispersed and formed into particles in a dispersion medium containing a dispersion stabilizer by means of an ordinary stirrer, a homomixer or a homogenizer preferably under such a condition that droplets of the polymerizable monomer composition can have a desired particle size of the resultant toner particles by controlling stirring speed and/or stirring time. Thereafter, the stirring may be continued in such a degree as to retain the particles of the polymerizable monomer composition thus formed and prevent the sedimentation of the particles. The polymerization may be performed at a temperature of at least 40° C., generally 50°–90° C., preferably 55°–85° C. The temperature can be raised at a later stage of the polymerization. It is also possible to subject a part of the aqueous system to distillation in a latter stage of or after the polymerization in order to remove the yet-unpolymerized part of the polymerizable monomer and a by-product which can cause an odor in the toner fixation step. After the reaction, the produced toner particles are washed, filtered out, and dried. In the suspension polymerization, it is generally preferred to use 300–3000 wt. parts of water as the dispersion medium per 100 wt. parts of the monomer composition.

In production of toner particles by the suspension polymerization using a dispersion stabilizer, it is preferred to use an inorganic or/and an organic dispersion stabilizer in an aqueous dispersion medium. Examples of the inorganic dispersion stabilizer may include: tricalcium phosphate, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica, and alumina. Examples of the organic dispersion stabilizer may include: polyvinyl alcohol, gelatin, methyl cellulose, methyl hydroxypropyl cellulose, ethyl cellulose, carboxymethyl cellulose sodium salt, and starch. These dispersion stabilizers may preferably be used in the aqueous dispersion medium in an amount of 0.2–2.0 wt. parts per 100 wt. parts of the polymerizable monomer composition.

In the case of using an inorganic dispersion stabilizer, a commercially available product can be used as it is, but it is also possible to form the stabilizer in situ in the dispersion medium so as to obtain fine particles thereof. In the case of tricalcium phosphate, for example, it is adequate to blend an aqueous sodium phosphate solution and an aqueous calcium chloride solution under an intensive stirring to produce tricalcium phosphate particles in the aqueous medium, suitable for suspension polymerization. In order to effect fine dispersion of the dispersion stabilizer, it is also effective to use 0.001–0.1 wt. % of a surfactant in combination, thereby promoting the prescribed function of the stabilizer. Examples of the surfactant may include: sodium dodecylbenzenesulfonate, sodium tetradecyl sulfate, sodium pentadecyl sulfate, sodium octyl sulfate, sodium oleate, sodium laurate, potassium stearate, and calcium oleate.

Regarding the colorant to be used for toner production by polymerization, it is necessary to pay attention to the polymerization-inhibiting function and transferability to the aqueous phase of the colorant. Accordingly, it is preferred to use the above-mentioned colorant after surface modification. For example, it is appropriate to hydrophobise the colorant so as not to inhibit the polymerization. Particularly, many dyes and carbon black can inhibit the polymerization, so that attention should be paid. As a preferred method of surface-treating a dye, a monomer may be polymerized in advance in the presence of the dye. The resultant colored polymer may be added to the polymerizable monomer composition. Carbon black can be treated in the same manner as the dye and can also be treated with a substance capable of reacting with the surface-functional group of the carbon black, such as polyorganosiloxane.

The toner according to the present invention may preferably have a shape factor SF-1 of 100–160, more preferably 100–150, further preferably 100–125.

The shape factor SF-1 referred to herein is based on values measured in the following manner. Images of 100 toner particles observed through a field emission scanning electron microscope (FE-SEM) ("S800", available from Hitachi Seisakusho K.K.) at a magnification of, e.g., 500 are sampled at random, and the image data of the toner images are inputted for analysis into an image analyzer (e.g., "Luzex III", available from Nireco K.K.) through an interface, whereby the shape factor SF-1 is calculated by the following equation:

$$SF\text{-}1=[(MXLNG)^2/\mathrm{AREA}]\times(\pi/4)\times 100,$$

wherein MXLNG denotes the maximum diameter of a toner particle and AREA denotes the projection area of the toner particles. The shape factor SF-1 referred to herein is defined as a number-average value of SF-1 values calculated in the above-described manner for the 100 toner particles selected at random. The shape factor SF-1 represents a degree of roundness, and a shape factor SF-1 closer to 100 means that the shape of a toner particle is closer to a true sphere.

In case where the shape factor SF-1 is larger than 160, the toner particles are substantially deviated from spheres but approach indefinite or irregularly shaped particles and correspondingly show a lowering in transfer efficiency (or transfer ratio).

The toner according to the present invention may ordinarily be used as a one-component type developer or a two-component type developer in combination with carrier particles. As a one-component type developer, magnetic toner comprising toner particles containing a magnetic material may be conveyed and charged by utilizing a developing sleeve containing a magnet. A non-magnetic toner containing no magnetic material may be triboelectrically charged by forced application thereof onto a developing sleeve by means of a blade or a roller and conveyed by attachment on the sleeve.

For a two-component type developer, the toner according to the present invention may be used together with a carrier. A magnetic carrier may comprise an element, such as iron, copper, zinc, nickel, cobalt, manganese or chromium alone or in a complex ferrite state. The shape of the magnetic carrier may be spherical or flat or irregular. It is preferred to control the surface micro-structure (e.g., surface unevenness) of the magnetic carrier particles. Generally, an oxide of the above-described element(s) may be calcined and formed into particles to prepare magnetic carrier core particles, which may be further coated with a resin. For the purpose of reducing the load of the magnetic carrier on the toner, it is possible to prepare a low-density dispersion-type carrier by melt-kneading of an inorganic oxide and a resin followed by pulverization and classification or prepare a true-spherical magnetic carrier by direct suspension polymerization of a kneaded mixture of an inorganic oxide and a monomer in an aqueous medium.

Coated carriers obtained by coating the above-mentioned carrier material with a resin, are particularly preferred. Various known coating methods may be adopted, inclusive of application of a solution or suspension liquid of a resin in a solvent, and blending of powdery resin and carrier particles.

Examples of the solid carrier-coating material may include: polytetrafluoroethylene, monochlorotrifluoroethylene, polyvinylidene fluoride, silicone resin, polyester resin, styrene resin, acrylic resin, polyamide, polyvinyl butyral, and amino-acrylate resin. These coating materials may be used singly or in mixture of two or more species.

The carrier may preferably have magnetic properties as follows. It is preferred to have a magnetization at 1000 oersted after magnetic saturation ($\sigma_{1000}$) of 30–300 emu/cm$^3$, more preferably 100–250 emu/cm$^3$, so as to accomplish high image qualities. Above 300 emu/cm$^3$, it becomes difficult to obtain high-quality toner images. Below 30 emu/cm$^3$, carrier attachment is liable to occur because of a small magnetic constraint force.

The carrier particles may preferably have a shape factor SF-1 (representing a remoteness from a sphere) of at most 180, and a shape factor SF-2 (representing a degree of unevenness) of at most 250. The shape factors SF-1 and SF-2 of carrier particles may be measured by observation of 100 particles taken at random through a scanning electron microscope and image analysis by an image analyzer (e.g., "Luzex III", available from Nireco K.K.). The calculation formula may be given as follows:

$$SF\text{-}1 = [(\text{carrier maximum length})^2/\text{area}] \times (\pi/4) \times 100$$

$$SF\text{-}2 = [(\text{carrier peripheral length})^2/\text{area}] \times (1/4\pi) \times 100$$

In the case of preparing a two-component type developer by blending the toner according to the present invention with a magnetic carrier, it is preferred to adopt a mixing ratio giving a toner concentration in the developer of 2–15 wt. %, more preferably 4–13 wt. %.

Image forming methods to which the toner according to the present invention is applicable will be described with reference to the drawings.

Figure 3:
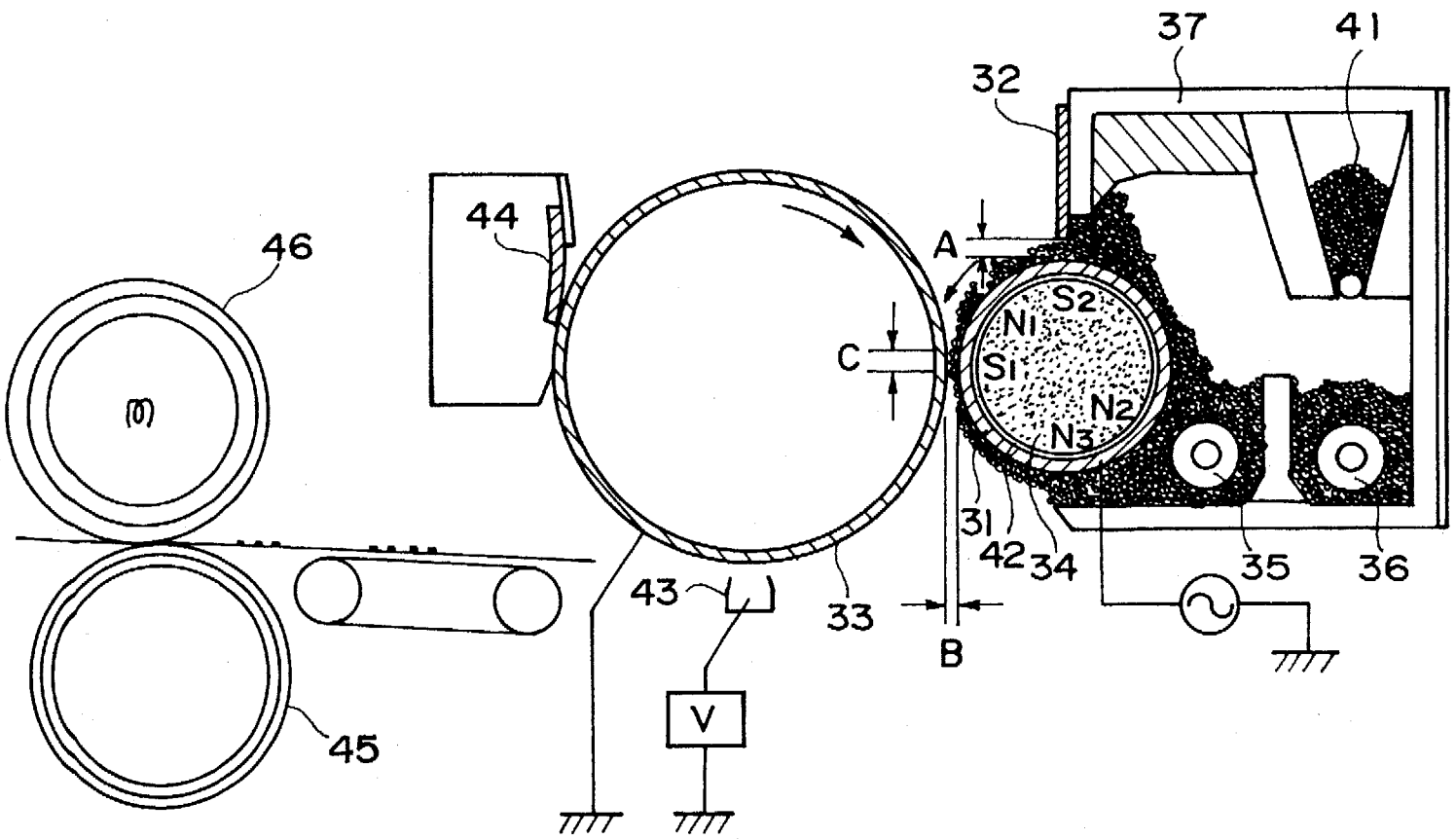
FIG. 3 is a schematic view for illustrating an image forming method to which the toner of the present invention is applicable.

The toner according to the present invention blended with a magnetic carrier may for example be applicable to an image forming method by using a developing means 37 as shown in FIG. 3. It is preferred to effect a development in a state where a magnetic brush contacts a latent image-bearing member, e.g., a photosensitive drum 33 under application of an alternating electric field. A developer-carrying member (developing sleeve) 31 may preferably be disposed to provide a gap B of 100–1000 μm from the photosensitive drum 33 in order to prevent the carrier attachment and improve the dot reproducibility. If the gap is narrower than 100 μm, the supply of the developer is liable to be insufficient to result in a low image density. In excess of 1000 μm, the lines of magnetic force exerted by a developing pole S1 is spread to provide a low density of magnetic brush, thus being liable to result in an inferior dot reproducibility and a weak carrier constraint force leading to carrier attachment. A toner 41 is successively supplied to the developing device and blended with a carrier by stirring (blending) means 35 and 36, and then is conveyed to a developing sleeve 42 enclosing therein a fixed magnet 34.

The alternating electric field may preferably have a peak-to-peak voltage (Vpp) of 500–5000 volts and a frequency of 500–10000 Hz, preferably 500–3000 Hz, which may be selected appropriately depending on the process. The waveform therefor may be appropriately selected, such as triangular wave, rectangular wave, sinusoidal wave or waveforms obtained by modifying the duty ratio. If the application voltage is below 500 volts it may be difficult to obtain a sufficient image density and fog toner on a non-image region cannot be satisfactorily recovered in some cases. Above 5000 volts, the latent image can be disturbed by the magnetic brush to cause lower image qualities in some cases.

By using a two-component type developer containing a well-charged toner, it becomes possible to use a lower fog-removing voltage (Vback) and a lower primary charge voltage on the photosensitive member, thereby increasing the life of the photosensitive member. Vback may preferably be at most 150 volts, more preferably at most 100 volts.

It is preferred to use a contrast potential of 200–500 volts so as to provide a sufficient image density.

The frequency can affect the process, and a frequency below 500 Hz may result in charge injection to the carrier, which leads to lower image qualities due to carrier attachment and latent image disturbance, in some cases. Above 10000 Hz, it is difficult for the toner to follow the electric field, thus being liable to cause lower image qualities.

In the developing method according to the present invention, it is preferred to set a contact width (developing nip) C of the magnetic brush on the developing sleeve 31 with the photosensitive drum 33 at 3–8 mm in order to effect a development providing a sufficient image density and excellent dot reproducibility without causing carrier attachment. If the developing nip C is narrower than 3 mm, it may be difficult to satisfy a sufficient image density and a good dot reproducibility. If broader than 8 mm, the developer is apt to be packed to stop the movement of the apparatus, and it may become difficult to sufficiently prevent the carrier attachment. The developing nip C may be appropriately adjusted by changing a distance A between a developer regulating member 32 and the developing sleeve 31 and/or changing the gap B between the developing sleeve 31 and the photosensitive drum 33.

In formation of a full color image for which a halftone reproducibility is a great concern may be performed by using at least 3 developing devices for magenta, cyan and yellow, adopting the toner according to the present invention and preferably adopting a developing system for developing digital latent images in combination, whereby a development faithful to a dot latent image becomes possible while avoiding an adverse effect of the magnetic brush and disturbance of the latent image. The use of the toner according to the present invention is also effective in realizing a high transfer ratio in a subsequent transfer step. As a result, it becomes possible to high image qualities both at the halftone portion and the solid image portion.

In addition to the high image quality at an initial stage of image formation, the use of the toner according to the present invention is also effective in avoiding the lowering in image quality in a continuous (successive) image formation on a large number of sheets.

The toner image formed on the electrostatic image-bearing member 33 is transferred onto a transfer-receiving material (such as plain paper) by a transfer means 43, such as a corona discharger. Then, the toner is fixed onto the transfer-receiving material by a hot-pressure fixing means including a heating roller 46 and a pressure roller 25 45 to form a fixed (toner) image on the transfer-receiving material. The transfer residual toner remaining on the electrostatic image-bearing member 33 is removed from the electrostatic image-bearing member 33 by a cleaning means 44 such as a cleaning blade. The toner according to the present invention shows a high transfer efficiency in the transfer step to have little transfer residual toner and also shows a good cleanability, thereby being less liable to cause filming on the electrostatic image-bearing member. Further, even in a continuous image formation on a large number of sheets, the toner according to the present invention is less liable to cause embedding of the external additive to the toner particle surfaces, so that good image qualities can be retained for a long period.

In order to provide good full color images, it is preferred to use four developing devices for magenta, cyan, yellow and black, respectively, and finally effect the black development.

An image forming apparatus suitable for practicing multicolor or full-color image forming method will be described with reference to FIG. 4.

Figure 4:
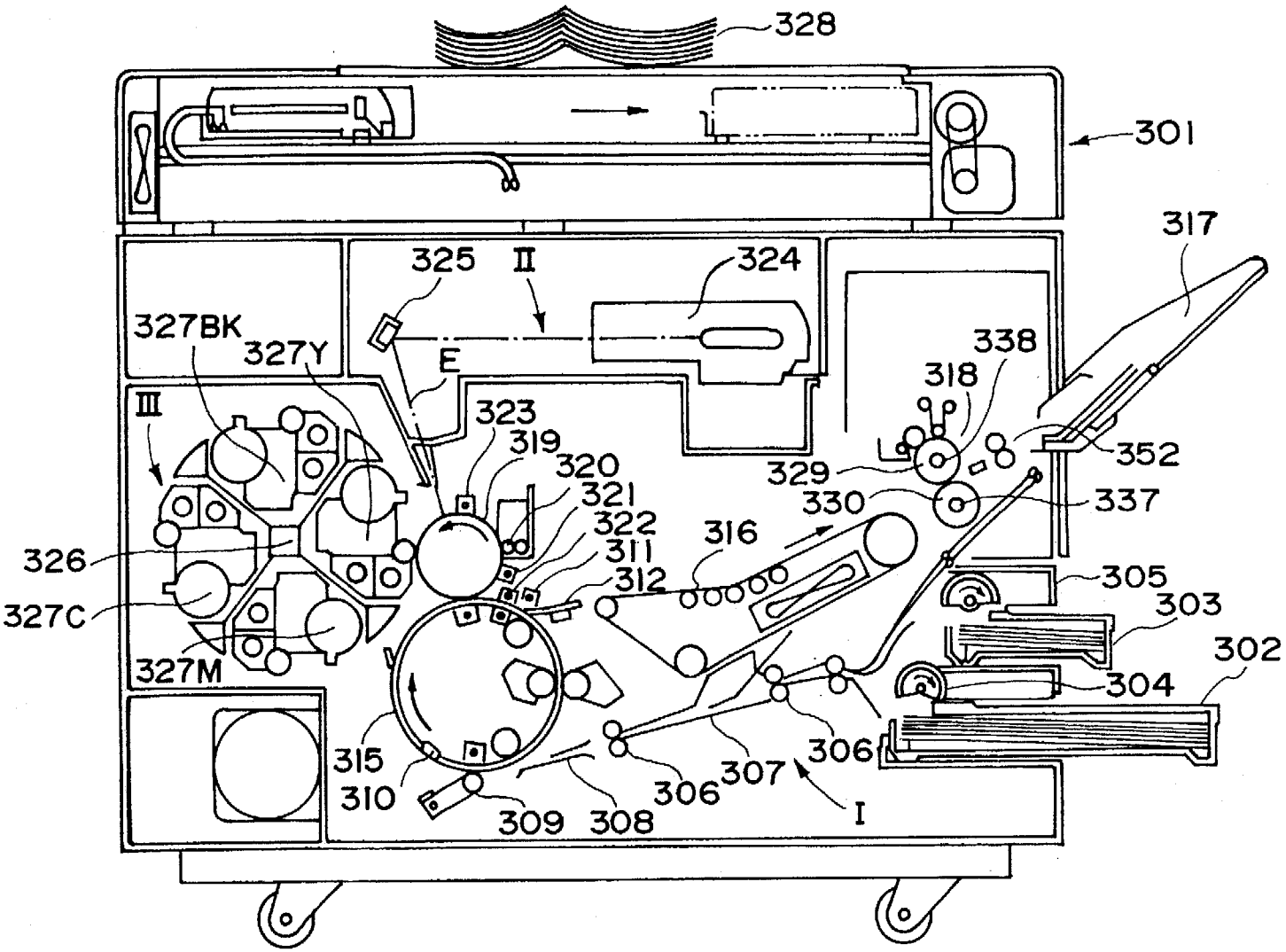
FIG. 4 is a schematic illustration of a full-color (or multi-color) image forming apparatus for practicing an image forming method to which the toner of the present invention is applicable.

The color electrophotographic apparatus shown in FIG. 4 is roughly divided into a transfer material (recording sheet) -conveying section I including a transfer drum 315 and extending from the right side (the right side of FIG. 4) to almost the central part of an apparatus main assembly 301, a latent image-forming section II disposed close to the transfer drum 315, and a developing means (i.e., a rotary developing apparatus) III.

The transfer material-conveying section I is constituted as follows. In the right wall of the apparatus main assembly, an opening is formed through which are detachably disposed transfer material supply trays 302 and 303 so as to protrude a part thereof out of the assembly. Paper (transfer material) -supply rollers 304 and 305 are disposed almost right above the trays 302 and 303. In association with the paper-supply rollers 304 and 305 and the transfer drum 315 disposed leftward thereof so as to be rotatable in an arrow A direction, paper-supply rollers 306, a paper-supply guide 307 and a paper-supply guide 308 are disposed. Adjacent to the outer periphery of the transfer drum 315, an abutting roller 309, a gripper 310, a transfer material separation charger 311 and a separation claw 312 are disposed in this order from the upperstream to the downstream alone the rotation direction.

Inside the transfer drum 315, a transfer charger 313 and a transfer material separation charger 314 are disposed. A portion of the transfer drum 315 about which a transfer material is wound about is provided with a transfer sheet (not shown) attached thereto, and a transfer material is closely applied thereto electrostatically. On the right side above the transfer drum 315, a conveyer belt means 316 is disposed next to the separation claw 312, and at the end (right side) in transfer direction of the conveyer belt means 316, a fixing device 318 is disposed. Further downstream of the fixing device is disposed a discharge tray 317 which is disposed partly extending out of and detachably from the main assembly.

The latent image-forming section II is constituted as follows. A photosensitive drum (e.g., an OPC photosensitive drum) as a latent image-bearing member rotatable in an arrow direction shown in the figure is disposed with its peripheral surface in contact with the peripheral surface of the transfer drum 315. Generally above and in proximity with the photosensitive drum 319, there are sequentially disposed a discharging charger 320, a cleaning means 321 and a primary charger 323 from the upstream to the downstream in the rotation direction of the photosensitive drum 319. Further, an imagewise exposure means including, e.g., a laser 324 and a reflection means like a mirror 325, is disposed so as to form an electrostatic latent image on the outer peripheral surface of the photosensitive drum 319.

The rotary developing apparatus III is constituted as follows. At a position opposing the photosensitive drum 319, a rotatable housing (hereinafter called a "rotary member") 326 is disposed. In the rotary member 326, four-types of developing devices are disposed at equally distant four radial directions so as to visualize (i.e., develop) an electrostatic latent image formed on the outer peripheral surface of the photosensitive drum 319. The four-types of developing devices include a yellow developing device 327Y, a magenta developing device 327M, a cyan developing apparatus 327C and a black developing apparatus 327BK.

The entire operation sequence of the above-mentioned image forming apparatus will now be described based on a full color mode. As the photosensitive drum 319 is rotated in the arrow direction, the drum 319 is charged by the primary charger 323. In the apparatus shown in FIG. 4, the moving peripheral speeds (herein sometimes called "process speed") of the respective members, particularly the photosensitive drum 319, may be at least 100 mm/sec, (e.g., 130–250 mm/sec). After the charging of the photosensitive drum 319 by the primary charger 323, the photosensitive drum 329 is exposed imagewise with laser light modulated with a yellow image signal from an original 328 to form a corresponding latent image on the photosensitive drum 319, which is then developed by the yellow developing device 327Y set in position by the rotation of the rotary member 326, to form a yellow toner image.

A transfer material (e.g., plain paper) sent via the paper supply guide 307, the paper supply roller 306 and the paper supply guide 308 is taken at a prescribed timing by the gripper 310 and is wound about the transfer drum 315 by means of the abutting roller 309 and an electrode disposed opposite the abutting roller 309. The transfer drum 315 is rotated in the arrow A direction in synchronism with the photosensitive drum 319 whereby the yellow toner image formed by the yellow-developing device 327Y is transferred onto the transfer material at a position where the peripheral surfaces of the photosensitive drum 319 and the transfer drum 315 abut each other under the action of the transfer charger 313. The transfer drum 315 is further rotated to be prepared for transfer of a next color (magenta in the case of FIG. 4).

On the other hand, the photosensitive drum 319 is charge-removed by the discharging charger 320, cleaned by a cleaning blade or cleaning means 321, again charged by the primary charger 323 and then exposed imagewise based on a subsequent magenta image signal, to form a corresponding electrostatic latent image. While the electrostatic latent image is formed on the photosensitive drum 319 by imagewise exposure based on the magenta signal, the rotary member 326 is rotated to set the magenta developing device 327M in a prescribed developing position to effect a development with a magenta toner. Subsequently, the above-mentioned process is repeated for the colors of cyan and black, respectively, to complete the transfer of four color toner images. Then, the four color-developed images on the transfer material are discharged (charge-removed) by the chargers 322 and 314, released from holding by the gripper 310, separated from the transfer drum 315 by the separation claw 312 and sent via the conveyer belt 316 to the fixing device 318, where the four-color toner images are fixed under heat and pressure. Thus, a series of full color print or image formation sequence is completed to provide a prescribed full color image on one surface of the transfer material.

Another image forming method will be described in detail while referring to FIG. 5.

Figure 5:
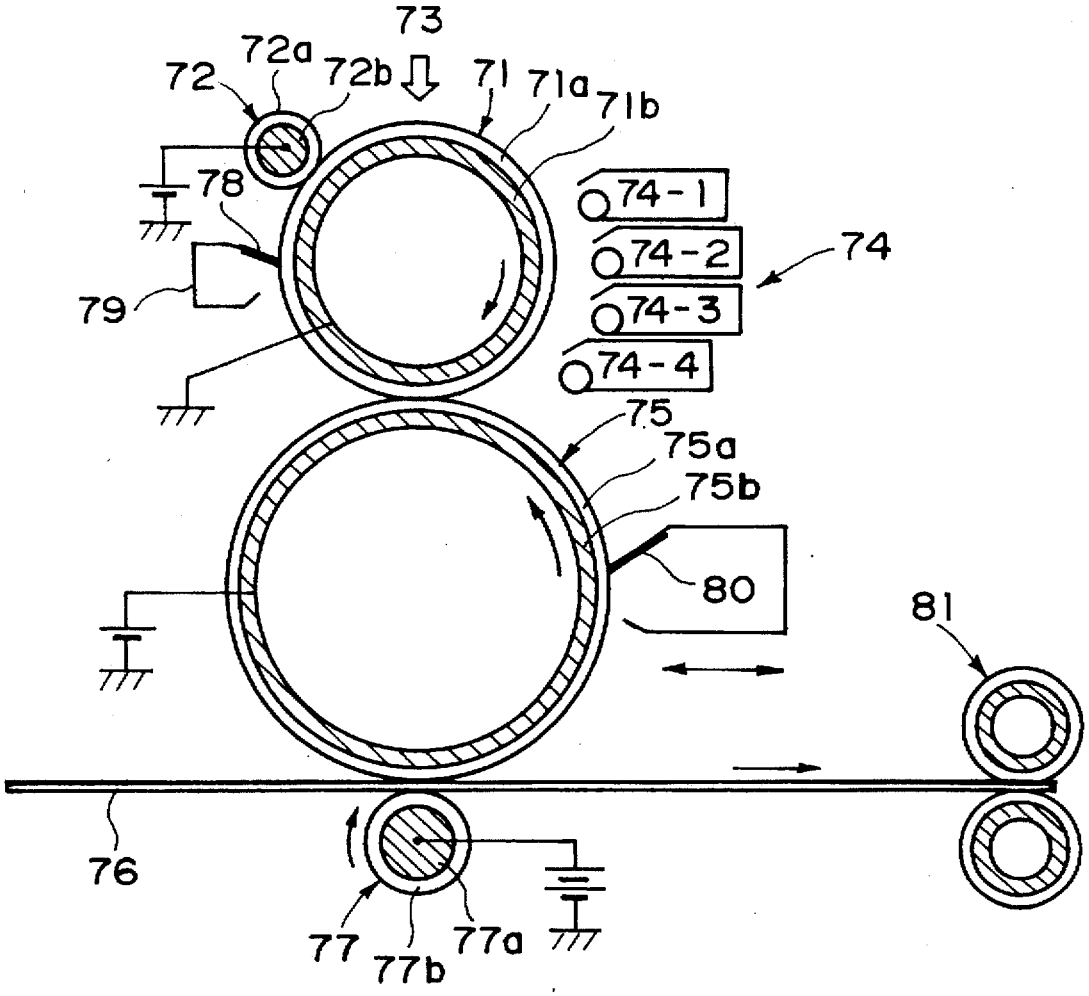
FIGS. 5 and 6 are respectively a schematic illustration of another image forming apparatus for practicing another image forming method.

Referring to FIG. 5, an image forming apparatus principally includes a photosensitive member 71 as an electrostatic image-bearing member, a charging roller 72 as a charging means, a developing device 74 comprising four developing units 74-1, 74-2, 74-3 and 74-4, an intermediate transfer member 75, a transfer roller 77 as a transfer means, and a fixing device 81 as a fixing means.

Four developers comprising cyan toner particles, magenta toner particles, yellow toner particles, and black toner particles are incorporated in the developing units 74-1 to 74-4. An electrostatic image is formed on the photosensitive member 71 and developed with the four color toner particles by a developing method such as a magnetic brush developing system or a non-magnetic monocomponent developing system, whereby the respective toner images are formed on the photosensitive member 71. The photoconductive member 71 comprises a support 71*a* and a photosensitive layer 71*b* thereon comprising a photoconductive insulating substance such as α-Si, CdS, $ZnO_2$, OPC (organic photoconductor), and α-Si (amorphous silicon). The photosensitive member 71 may preferably comprise an α-Si photosensitive layer or OPC photosensitive layer. The photosensitive member 71 is rotated in a direction of an arrow by a drive mean (not shown).

The organic photosensitive layer may be composed of a single layer comprising a charge-generating substance and a charge-transporting substance or may be a function-separation type photosensitive layer comprising a charge generation layer and a charge transport layer. The function-separation type photosensitive layer may preferably comprise an electroconductive support, a charge generation layer, and a charge transport layer arranged in this order. The organic photosensitive layer may preferably comprise a binder resin such as polycarbonate resin, polyester resin or acrylic resin because such a binder resin is effective in improving transferability and cleaning characteristic and causes little toner sticking onto the photosensitive member and filming of external additives.

A charging step may be performed by non-contact charging using a corona charger which is not in contact with the photosensitive member 71 or by contact charging using, e.g., a charging roller. The contact charging as shown in FIG. 5 may preferably be used in view of efficiently uniform charging, simplification and a lowering in amount of by-produced ozone. The charging roller 72 comprises a core metal 72*b* and an electroconductive elastic layer 72*a* surrounding a periphery of the core metal 72*b*. The charging roller 72 is pressed against the photosensitive member 71 at a prescribed pressure (pressing force) and rotated while being mated with the rotation of the photosensitive member 71.

The charging step using the charging roller may preferably performed under process conditions including an applied pressure of the roller of 5–500 g/cm, an AC voltage of 0.5–5 kvpp, an AC frequency of 50 Hz–5 kHz and a DC voltage of ±0.2–±1.5 kV in the case of applying superposed voltage of AC voltage and DC voltage; and an applied pressure of the roller of 5–500 g/cm and a DC voltage of ±0.2–±1.5 kV in the case of applying DC voltage.

Other charging means may include those using a charging blade or an electroconductive brush. These contact charging means are effective in omitting a high voltage or decreasing in occurrence of ozone. The charging roller and charging blade each used as the contact charging means may preferably comprise an electroconductive rubber and may optionally comprise a releasing film on the surface thereof. The releasing film may preferably comprise a nylon-based resin, polyvinylidene fluoride (PVDF) or polyvinylidene chloride (PVDC).

The toner image formed on the photosensitive member is transferred to the intermediate transfer member 75 to which a voltage (e.g., ±0.1–±5 kV) is applied. The photosensitive member surface after the transfer is cleaned by a cleaning member 79 including a cleaning blade 78.

The intermediate transfer member 75 comprises a pipe-like electroconductive core metal 75*b* and a medium resistance-elastic layer 75*a* (e.g., an elastic roller) surrounding a periphery of the core metal 75*b*. The core metal 75*b* may be one comprising a plastic pipe which has been subjected to electroconductive plating. The medium resistance-elastic layer 75*a* may be a solid layer or a foamed material layer in which an electroconductivity-imparting substance such as carbon black, zinc oxide, tin oxide or silicon carbide is mixed and dispersed in an elastic material such as silicone rubber, teflon rubber, chloroprene rubber, urethane rubber or ethylene-propylene-dien terpolymer (EPDM) so as to control an electric resistance or a volume resistivity at a medium resistance level of $10^5$–$10^{11}$ ohm.cm. The intermediate transfer member 75 is disposed under the photosensitive member 71 so that it has an axis (or a shaft) disposed in parallel with that of the photosensitive member 71 and is in contact with the photosensitive member 71. The intermediate transfer member 75 is rotated in the direction of an arrow (counterclockwise direction) at a peripheral speed identical to that of the photosensitive member 71.

The respective color toner images are successively intermediately transferred to the peripheral surface of the intermediate transfer member 75 by an electric field formed by applying a transfer bias to a transfer nip region between the photosensitive member 71 and the intermediate transfer member 75 at the time of passing through the transfer nip region.

After the intermediate transfer of the respective toner image, the surface of the intermediate transfer member 75 is cleaned, as desired, by a cleaning means 80 which can be attached to or detached from the image forming apparatus. In case where the toner image is placed on the intermediate transfer member 75, the cleaning means 80 is detached or released from the surface of the intermediate transfer member 75 so as not to damage the toner image.

The transfer means (e.g., a transfer roller) 77 is disposed under the intermediate transfer member 75 so that it has an axis (or a shaft) disposed in parallel with that of the intermediate transfer member 75 and is in contact with the intermediate transfer member 75. The transfer means (roller) 77 is rotated in the direction of an arrow (clockwise direction) at a peripheral speed identical to that of the intermediate transfer member 75. The transfer roller 77 may be disposed so that it is directly in contact with the intermediate transfer member 75 or in contact with the intermediate transfer member 75 by the medium of a belt, etc. The transfer roller 77 may be constituted by disposing an electroconductive elastic layer 77*a* on a peripheral surface of a core metal 77*b*.

The intermediate transfer member 75 and the transfer roller 77 may comprise known materials as generally used. In the present invention, by setting a volume resistivity of the elastic layer 75*a* of the intermediate transfer member 75 higher than that of the elastic layer 77*b* of the transfer, it is possible to alleviate a voltage applied to the transfer roller 77. As a result, a good toner image is formed on the transfer-receiving material and the transfer-receiving material is prevented from winding about the intermediate transfer member 75. The elastic layer 75*a* of the intermediate transfer member 75 may preferably has a volume resistivity at least ten times higher than that of the elastic layer 77*b* of the transfer roller 77.

The intermediate transfer member 75 may preferably comprise the elastic layer 75*a* having a hardness of 10–40 as measured by JIS K-6301. On the other hand, the transfer roller 77 may preferably comprise an elastic layer 77*a* having a hardness higher than that of the elastic layer 75*a* of the intermediate transfer member 75, more preferably a hardness of 41–80 as measured by JIS K-6301 for preventing the transfer-receiving material from winding about the intermediate transfer member 75. If the hardness of the elastic layer 77*a* of the transfer roller 77 is lower than that of the elastic layer 75*a* of the intermediate transfer member 75, a concavity (or a recess) is formed on the transfer roller side, thus being liable to cause the winding of the transfer-receiving material about the intermediate transfer member 75.

The transfer roller 77 may be rotated at the same or different peripheral speed as that of the intermediate transfer member 75. The transfer-receiving material 76 is conveyed to a nip, between the intermediate transfer member 75 and the transfer roller 77, at which a toner image on the intermediate transfer member 75 is transferred to the front surface of the transfer-receiving material 76 by applying a transfer bias having a polarity opposite to that of triboelectric charge of the toner particles to the transfer roller 77.

The transfer roller 77 may comprise materials similar to those constituting the charging roller 72. The transfer step may be performed under conditions including a pressure of the transfer roller of 5–500 g/cm and a DC voltage of ±0.2–±10 kV. More specifically, the transfer roller 77 comprise a core metal 77*b* and an electroconductive elastic layer 77*a* comprising an elastic material having a volume resistivity of $10^6$–$10^{10}$ ohm.cm, such as polyurethane or ethylene-propylene-dien terpolymer (EPDM) containing an electroconductive substance, such as carbon, dispersed therein. A certain bias voltage (e.g., preferably of ±0.2–±10 kV) is applied to the core metal 77*b* by a constant-voltage supply.

The transfer-receiving material 76 is then conveyed to the fixing device 81 comprising two rollers including a heated roller enclosing a heating member (e.g., a halogen heater) and a pressure roller pressed against the heated roller at a prescribed pressure. The toner image on the transfer-receiving material 76 is passed between the heated roller and the pressure roller to fix the toner image on the transfer-receiving material 76 under application of heat and pressure. The fixing step may also be performed by applying heat to the toner image by the medium of a film by a heater.

Figure 6:
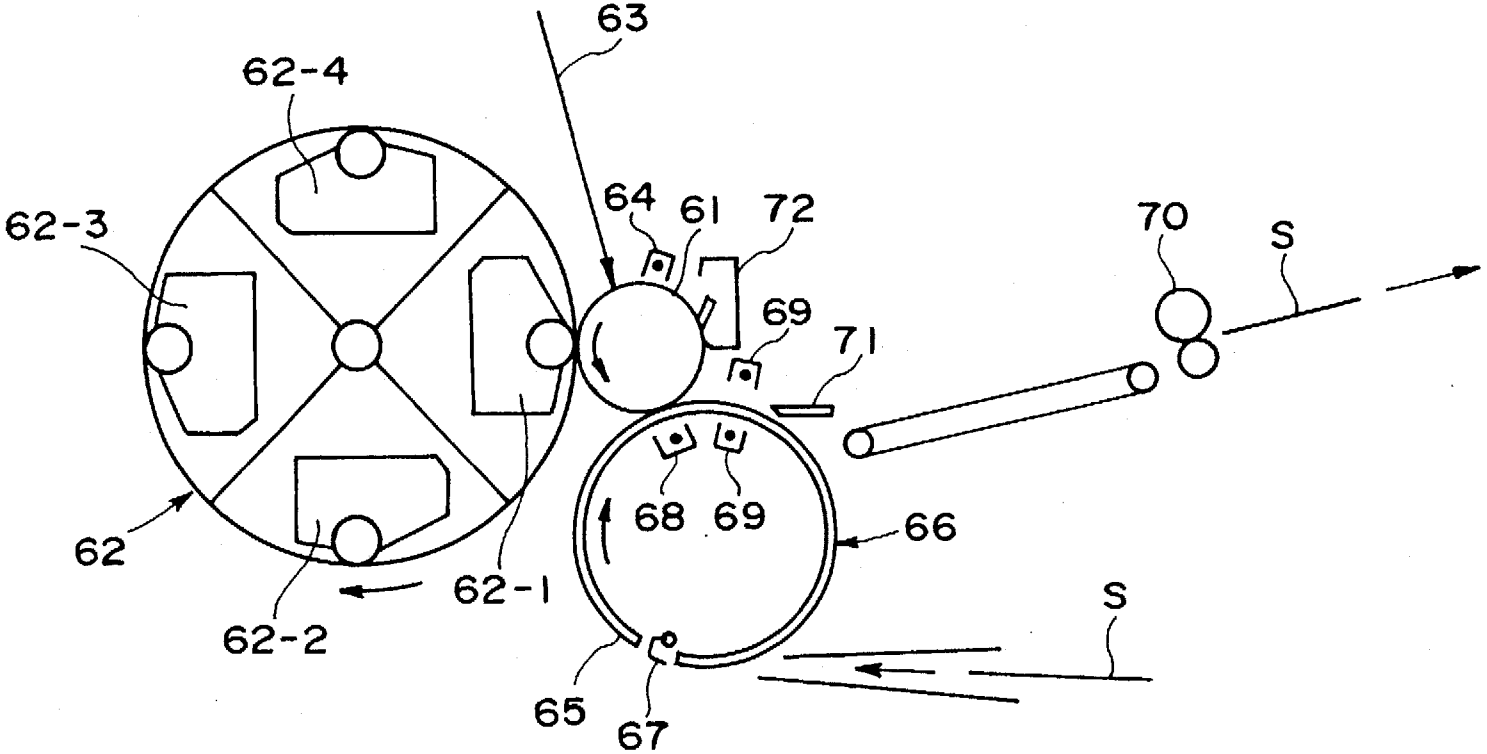

FIG. 6 shows an embodiment for illustrating another image forming method.

In the image forming method shown in FIG. 6, an electrostatic image formed on a photosensitive drum 61 by irradiation of exposure light 63 is developed with a two-component developer, comprising a first color toner and a carrier, contained in a developing device 62-1 attached to a rotary developing unit 62 rotated in the direction of an arrow, thereby to form a toner image. The toner image on the photosensitive drum is transferred onto a transfer-receiving material (recording material) S held by a gripper 67 on a transfer drum 66 by using a transfer charger 68.

The transfer charger 68 may comprise a corona charger and a contact charger. In the case of using the corona charger as the transfer charger, an applied voltage of −10 KV to +10 KV is used and a transfer current of −500 μA to +500 μA is used. A holding member 65 is disposed at the peripheral surface of the transfer drum 66, and comprises a dielectric material sheet or film composed of polyvinylidene fluoride or polyethylene terephthalate. For example, the dielectric material sheet may have a thickness of 100–200 μm and a volume resistivity of $10^{12}$–$10^{14}$ ohm.cm.

In order to provide a second color, the rotary developing unit 62 is rotated, whereby a developing device 62-2 is located in a position opposite to the photosensitive drum 61. An electrostatic image is developed with a (two-component type) developer comprising a second color toner and a carrier contained in the developing device 62-2 to form a toner image, which is then transferred onto and superposed on the toner image (already formed) on the transfer-receiving material S.

Similarly, the above step is repeated with respect to a third color and a fourth color, respectively.

As described above, the transfer drum 66 is rotated prescribed times while holding (carrying) the transfer-receiving material S, thus effecting multiple transfer of toner images including prescribed color toners. It is preferred to increase a transfer current for performing electrostatic transfer in the following order: first color<second color<third color<fourth color. This is because a residual toner after the transfer operation remaining on the photosensitive drum 61 can be decreased.

If the transfer current is too high, a transfer image is undesirably disordered. In the present invention, however, the toner is excellent in transferability to well effect transfer with respect to second to fourth colors during the multiple transfer without increasing the transfer current. Accordingly, any color image can be stably formed, thus allowing excellent and well-controlled multiple-color image. Further, in the case of full-color image formation, it is possible to obtain a beautiful image excellent in color reproducibility. Further, a higher transfer current is not required, thus minimizing image disorder in the transfer step. Further, when the transfer-receiving material is separated from the transfer drum 66, a separation charger 69 is used for charge removal. At this time, if the transfer current is large, an electrostatic adsorption of the transfer-receiving material S to the transfer drum 66 becomes large. As a result, it is difficult to effect separation of the transfer-receiving material unless a larger current for separation is applied. The separation current has a polarity opposite to the transfer current, so that toner image disorder or toner scattering from the transfer-receiving material is caused to soil the interior of the image forming apparatus. The toner of the present invention is readily transferred to allow easy separation without using a larger separation current. As a result, image disorder or toner scattering at the time of separation of the transfer-receiving material can effectively be suppressed. Accordingly, the toner of the present invention may particularly preferably be used in an image forming method including a multiple transfer step for providing multi-color or full-color images.

The transfer-receiving material after the multiple transfer is separated from the transfer drum 66 by the separation charger 69 and fixed by heat-pressure rollers (fixing device) 70 including a web impregnated with silicone oil to effect color-mixing at the time of fixation, thus forming a full-color image.

Replenishing toners are supplied from respective replenishing hoppers for respective colors to the respective developing devices 62-1 to 62-4 in such a manner that a prescribed amount of a toner is conveyed to a toner replenishing cartridge disposed in the center of the rotary developing unit 62 via a toner conveying cable in accordance with a replenishment signal and then is supplied to the respective developing devices.

Then, a mono-component developing method will be described. The toner of the present invention step is applicable to known monocomponent developing methods, such as the magnetic monocomponent developing method and the non-magnetic monocomponent developing method.

The magnetic monocomponent method is described with reference to FIG. 7.

Figure 7:
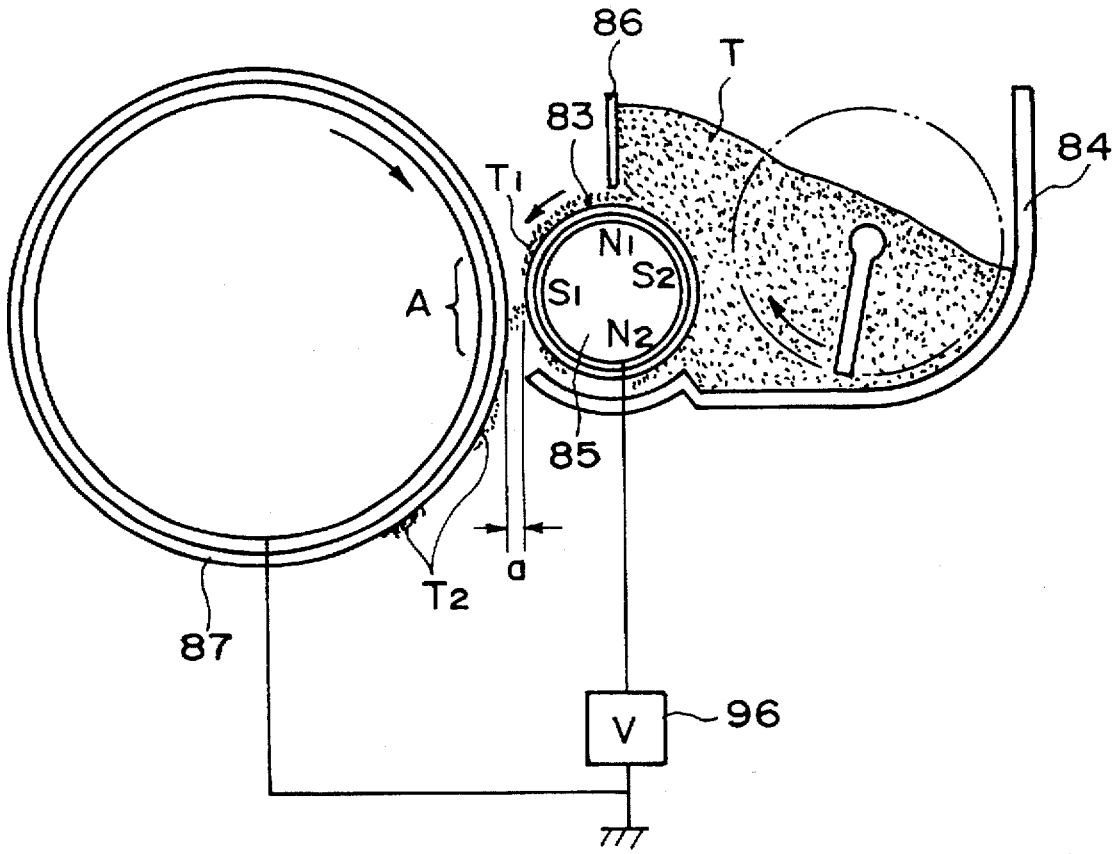
FIGS. 7–9 are respectively a schematic illustration of a developing device to which the toner of the present invention is applicable.

Referring to FIG. 7, almost a right half of a developing sleeve 83 is always contacted with a toner stock in a toner vessel 84, and a toner T in the vicinity of the developing sleeve 83 surface is attached to the sleeve surface under a magnetic force exerted by a magnetic force generating means 85 in the sleeve 83 and/or an electrostatic force. As the developing sleeve 83 is rotated, the magnetic toner layer is formed into a thin magnetic toner layer $T_1$ having an almost uniform thickness while moving through a regulating member 86. The magnetic toner is charged principally by a frictional contact between the sleeve surface and the magnetic toner caused by the rotation of the developing sleeve 83. The magnetic toner thin layer on the developing sleeve 83 is rotated to face a latent image-bearing member 87 in a developing region A at the closest gap $\alpha$ between the latent image-bearing member 87 and the developing sleeve 83. At the time of passing through the developing region A, the magnetic toner in a thin layer is caused to jump and reciprocally move through the gap $\alpha$ between the latent image-bearing member 87 and the developing sleeve 83 surface at the developing region A under an AC-superposed DC electric field applied between the latent image-bearing member 87 and the developing sleeve 83 by a bias voltage application means 96. Consequently, the magnetic toner on the developing sleeve 83 is selectively transferred and attached to form a toner image $T_2$ successively on the latent image-bearing member 87 depending on a latent image potential pattern on the member 87.

The developing sleeve surface having passed through the developing region A and selectively consumed the magnetic toner is returned by rotation to the toner stock in the vessel 84 to be replenished with the magnetic toner, followed by repetition of the magnetic thin toner layer $T_1$ on the sleeve 83 and development at the developing region A.

The regulating means 86 as a means for providing a thin toner layer used in the embodiment shown in FIG. 7 may include: a doctor blade, such as a metal blade or a magnetic blade, disposed opposite to the developing sleeve 83 with a prescribed spacing; and rollers of metal, resin and ceramics. Further, the regulating means 86 may comprise an elastic blade (e.g., a blade 80 shown in FIG. 8) or an elastic roller abutted against the developing sleeve (toner-carrying member) surface.

The elastic blade or elastic roller may comprise, e.g., elastomers, such as silicone rubber, urethane rubber and NBR; elastic synthetic resins, such as polyethylene terephthalate; and elastic metals, such as steel, stainless steel and phosphorus bronze. A composite material of these can also be used. It is preferred to use an elastomeric rubber or resin as a material for constituting an abutment portion against the developing sleeve 83.

Figure 8:
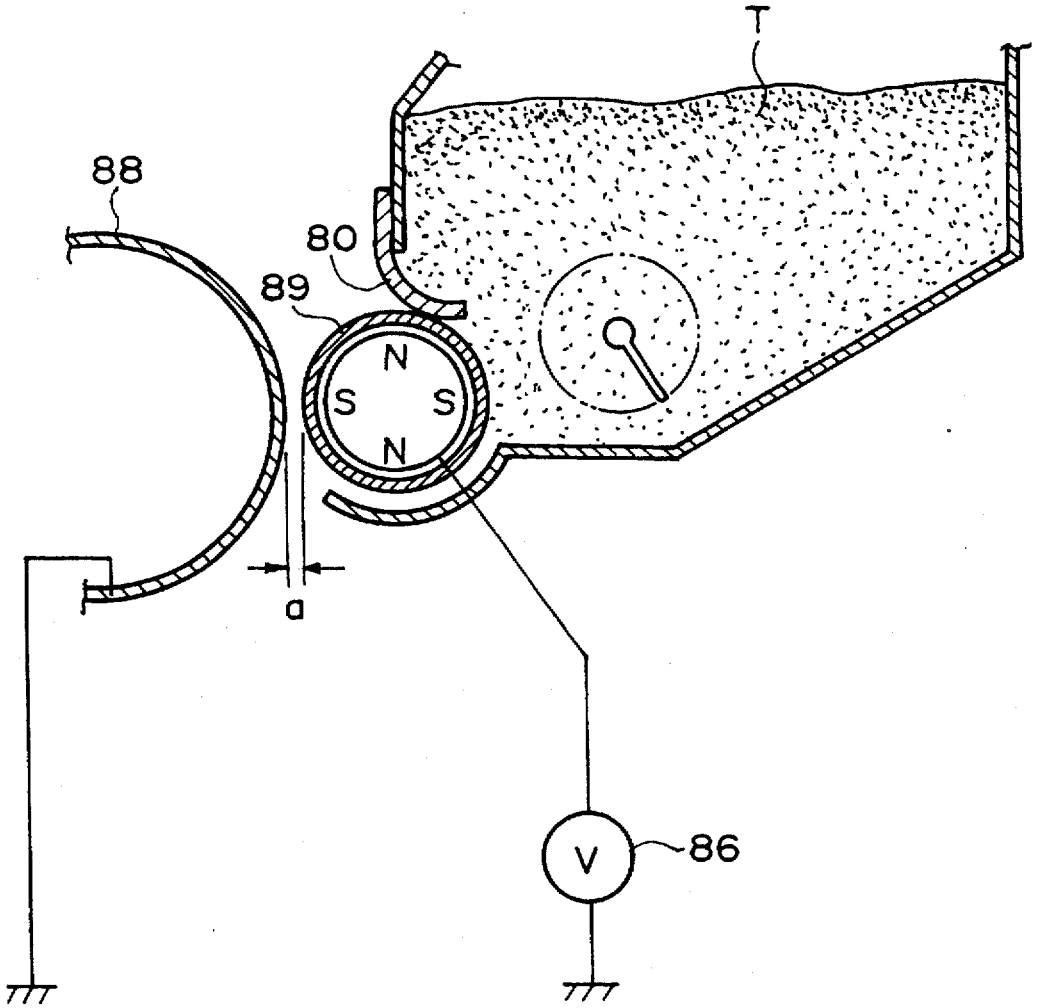

FIG. 8 shows an embodiment using an elastic blade for the magnetic monocomponent development.

An upper side of an elastic blade 80 is fixed to a developer vessel and the lower side is pressed with a bending in resistance to the elasticity of the elastic blade 80 against a developing sleeve 89 so as to extend in a direction forward or reverse with respect to the rotation direction of the developing sleeve 89 and exert an appropriate elastic pressure against the sleeve surface with its inner side (or outer side in case of the reverse abutment). By using such an apparatus, it is possible to form a thin but dense layer in a more stable manner regardless of changes in environmental conditions.

In the case of using the elastic blade, the toner is liable to cause melt-sticking onto the surface of the sleeve and/or blade. However, the toner according to the present invention is excellent in releasability and has a stable triboelectric chargeability, thus being preferably applicable to the elastic blade.

The abutting pressure between the blade 80 and the sleeve 89 in the case of the magnetic monocomponent developing method may be at least 0.1 kg/m, preferably 0.3–25 kg/m, further preferably 0.5–12 kg/m, in terms of a linear pressure along the generatrix of the sleeve.

The spacing a between a latent image-bearing member 88 and the developing sleeve 89 may be set to e.g., 50–500 μm.

The thickness of the magnetic toner layer on the developing sleeve 89 is most suitably smaller than a gap a between the latent image-bearing member 88 and the developing sleeve 89. It is however possible to set the toner layer thickness such that a portion of many ears of magnetic toner can touch the latent image bearing member.

The developing sleeve 89 is rotated at a peripheral speed of 100–200% of that of the latent image-bearing member 88. The alternating bias voltage by a bias voltage application means 86 may be at least 0.1 kV, 0.1 kV, preferably 0.2–3.0 kV, further preferably 0.3–2.0 KV, in terms of a peak-to-peak voltage. The frequency may be 0.5–5.0 kHz, preferably 1.0–3.0 kHz, further preferably 1.5–3.0 kHz. The alternating bias voltage waveform may be rectangular, sinusoidal, saw teeth-shaped or triangular. A normal-polarity voltage, a reverse-polarity voltage or an asymmetrical AC bias voltage having different durations may also be used. It is also preferable to superpose a DC bias voltage.

Figure 9:
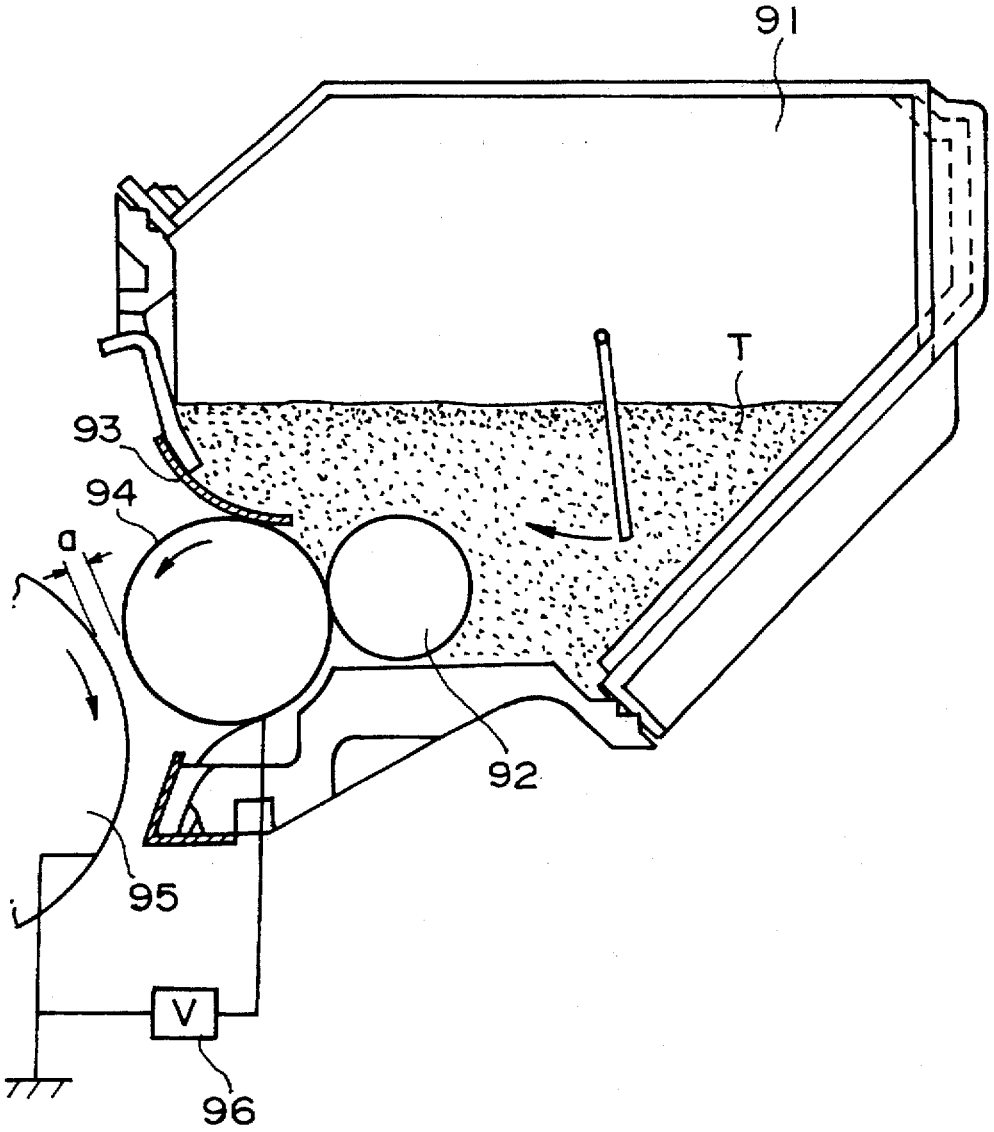

Next, a non-magnetic monocomponent developing method will be described with reference to FIG. 9. Referring to FIG. 9, a reference numeral 95 denotes a latent image-bearing member. An electrostatic image may be formed by an electrophotographic means or electrostatic recording means (not shown). A developing sleeve (toner-carrying member) 94 comprises a non-magnetic sleeve composed of aluminum or stainless steel.

The developing sleeve 94 can comprise a crude pipe of aluminum or stainless steel as it is. However, the surface thereof may preferably be uniformly roughened by blasting with spherical particles such as glass beads, etc., mirror-finished or coated with a resin.

Toner T is stored in a hopper 91 and supplied to the developing sleeve 94 by a toner application roller 92. The toner application roller 92 may preferably comprise a foam material of porous elastomer, such as soft polyurethane foam and is rotated at a non-zero relative speed with the developing sleeve 94 in a direction identical or reverse to that of the developing sleeve. In addition to the toner supply, the toner application roller 92 functions to peel off the toner remaining on the developing sleeve 94 without being used after the development. In this case, the toner application roller may preferably have an abutting width (nip width) with respect to the developing sleeve 94 of 2.0–10.0 mm, more preferably 4.0–6.0 mm in view of a balance of the toner supply and peeling-off. At this time, a certain stress is exerted on the toner, thus being liable to cause increased toner agglomeration due to deterioration thereof and/or melt sticking (filming) of the toner onto the developing sleeve 94 and the toner application roller 92. However, the toner of the present invention is excellent in flowability and releasability and has a stable durability, thus being preferably used even in a developing device shown in FIG. 9. Further, instead of the toner application roller 92, a brush roller comprising a fibrous resin such as nylon or rayon. The developing method shown in FIG. 9 is very effective for the monocomponent developing method using the non-magnetic monocomponent toner.

The toner supplied to the developing sleeve 94 is uniformly applied by a regulating blade 93 to form a thin layer on the sleeve 94. The regulating member 93 may comprise an elastic blade or an elastic roller and may preferably one applying a toner to the developing sleeve 94 surface under pressure and abutment. The elastic blade or roller may preferably comprise a material having a triboelectric chargeability suitable for charging the toner so as to have a desired polarity. The regulating member may suitably be composed of silicone rubber, urethane rubber, styrene-butadiene rubber, etc., and can be coated with an organic resin layer comprising resins, such as polyamide, polyimide, nylon, melamine, melamine-crosslinked nylon, phenolic resin, fluorine-containing resin, silicone resin, polyester resin, urethane resin and acrylic resin.

The abutting pressure between the elastic blade or elastic roller and the developing sleeve 94 may suitably be 0.1–25 kg/m, preferably 0.5–12 kg/m, in terms of a linear pressure along the generatrix of the sleeve. By controlling the abutting pressure within a range of 0.1–25 kg/m, the toner according to the present invention can effectively be disintegrated from agglomeration, and the toner can be quickly charged.

In the toner application system using a blade to form a thin layer of toner on a developing sleeve 94, particularly in the case of non-magnetic monocomponent developing method, the developing sleeve 94 is rotated at a peripheral speed of 100–300%, preferably 120–250%, of that of the latent image-bearing member 95 in order to provide a sufficient image density. Further, it is preferred that the toner layer thickness on the developing sleeve 94 is set to be smaller than a gap between the developing sleeve 94 and the latent image-bearing member 95, and an alternating electric field is applied across the gap. A developing bias voltage of an alternating electric field optionally superposed with a DC electric field may be applied across the gap between the developing sleeve 94 and the latent image-bearing member 95 from a bias voltage supply 96 so as to promote the movement of the toner from the developing sleeve 94 to the latent image-bearing member 95, thereby providing a better quality image.

Hereinbelow, some methods for measuring the properties of toners and for evaluating toner performances including developing characteristics, fixation characteristics, image quality, etc., referred to herein will be described.

Toner particle size distribution

Coulter Counter TA-II or Coulter Multisizer II (available from Coulter Electronics Inc.) is used together with an electrolytic solution comprising a ca. 1% NaCl aqueous solution which may be prepared by dissolving a reagent-grade sodium chloride or commercially available as "ISOTON-II" (from Counter Scientific Japan).

For measurement, into 100 to 150 ml of the electrolytic solution, 0.1 to 5 ml of a surfactant (preferably an alkyl benzenesulfonic acid salt) is added as a dispersant, and 2–20 mg of a sample is added. The resultant dispersion of the sample in the electrolytic solution is subjected to a dispersion treatment by an ultrasonic disperser for ca. 1–3 min., and then subjected to measurement of particle size distribution by using the above-mentioned apparatus equipped with a 100 μm-aperture. The volume and number of toner particles are measured for respective channels to calculate a volume-basis distribution and a number-basis distribution of the toner. From the volume-basis distribution, a weight-average particle size ($D_4$) of the toner is calculated by using a central value as a representative for each channel.

The channels used include 13 channels of 2.00–2.52 μm; 2.52–3.17 μm; 3.17–4.00 μm; 4.00–5.04 μm; 5.04–6.35 μm; 6.35–8.00 μm; 8.00–10.08 μm, 10.08–12.70 μm; 12.70–16.00 μm; 16.00–20.20 μm; 20.20–25.40 μm; 25.40–32.00 μm: and 32.00–40.30 μm.

Coefficient of variation

The coefficient of variation in number (A) of the toner particles used in the present invention may be defined by the following equation:

$$\text{Coefficient of variation } (A)\ (\%)=(S/D_1)\times 100,$$

wherein S denotes a standard deviation on number-basis distribution of the toner particles, and $D_1$ denotes a number-average particle size (μm) of the toner particles.

Triboelectric charge (TC) in various environments

A sample toner and a carrier are left standing one whole day in an environment concerned, such as a high temperature/high humidity environment (30° C./80% RH; HT/HH) a normal temperature/normal humidity environment (23° C./60% RH; NT/NH), or a low temperature/low humidity environment (15° C./10% RH; LT/LH), and then subjected to measurement according to the blow-off method in the below-described manner.

An apparatus as shown in the sole figure is used for measurement of a triboelectric charge(ability) of a toner. First, a mixture of a sample toner and a carrier in a weight ratio of 1:19 is placed in a polyethylene bottle of 50–100 ml in volume, and the bottle is shaked for 5–10 min. by hands. Then, ca. 0.5–1.5 g of the mixture (developer) is taken and placed in a metal measurement vessel 2 equipped with 50 mesh-screen 3 at its bottom, and the vessel is covered with a metal lid 4. The total weight ($W_1$ g) of the measurement vessel at this time is measured. Then, an aspirator 1 (of which the portion contacting the vessel 2 is insulating) is operated by sucking through a suction outlet 7 while adjusting an air control valve 6 to provide a pressure of 250 mmAq at a vacuum gauge 5. In this state, the aspiration is sufficiently performed, preferably about 2 min., to remove the toner by sucking. The potential on a potential meter 9 connected to the vessel 2 via a capacitor 8 (having a capacitance C (μF) is read at V volts. The total weight ($W_2$ g) after the aspiration is measured, and the triboelectric charge of the toner is calculated according to the following equation:

$$\text{Triboelectric charge } (mC/kg)=C\times V/(W_1-W_2).$$

Triboelectricity on a sleeve (TC sleeve) The triboelectric charge of a toner on a developing sleeve is measured by using a suction-type Faraday cage in the following manner.

An outer cylinder of the Faraday cage is pushed against a developing sleeve to recover by sucking the toner on a certain area of the developing sleeve on a filter of the inner cylinder, so that the sucked toner sample weight is calculated from the weight increase of the filter. At the same time, the amount of charge accumulated at the inner cylinder electrostatically isolated from the exterior member to obtain the charged electricity of the magnetic toner on the developing sleeve.

Image density

The image density is measured at a fixed image portion having a toner concentration (weight per unit area) of 0.60 mg/cm$^2$ by using a Macbeth reflection densitometer ("RD918", available from Macbeth Co.).

Image quality of halftone portion and solid portion (In case of two-component development)

Image qualities of a halftone portion and a solid portion are compared with those of a standard image sample and evaluated at four levels below since the image qualities are largely affected by soil of a carrier and/or a photosensitive drum during successive image formation.

A: excellent,

B: good,

C: fair,

D: poor.

(In case of non-magnetic mono-component development)

Image qualities of a halftone portion and a solid portion are compared with those of a standard image sample and evaluated at four levels below since the image qualities are largely affected by toner-sticking onto a developing sleeve and toner application irregularity (uneven toner layer) on a developing sleeve during successive image formation.

A: excellent,

B: good,

C: fair,

D: poor.

Fog

Based on reflectance values measured by using a reflectance meter ("REFLECTOMETER MODEL TC-6DS", available from Tokyo Denshoku K.K.) while using an amber filter in case of cyan toner images, fogs are calculated according to the following equation. A smaller value means a lower degree of fog.

Fog (reflectance) (%)=[reflectance of standard paper (%)] −[reflectance of non-image portion of a sample (%)]

Fogs are evaluated at four levels below.

A (excellent): fog (%) is at most 1.2%.

G (good): fog (%) is above 1.2% to 1.6%.

C (fair): fog (%) is above 1.6% to 2.0%.

D (unacceptable): fog (%) is above 2.0%.

Fixability and anti-offset characteristic

To toner particles, an appropriate amount of external additive is added to provide a developer. The developer is used in a commercially available copier to form yet-unfixed images.

The unfixed toner images are subjected to fixation by an external hot roller fixing device equipped with no oil application, thereby evaluating the fixability and anti-offset characteristic and also obtaining a fixed toner image for evaluation of the transparency.

The upper and lower fixing rollers (each having a diameter of 40 mm) comprise a fluorine-containing resin or rubber. The fixing conditions include a nip of 5.5 mm and a fixation speed of 120 mm/sec for fixation on plain paper ("SK paper", mfd. by Nippon Seishi K.K.), and a nip of 5.5 mm and a fixation speed of 35 mm/sec for fixation on an OHP sheet ("CG3300", mfd. by Minesota Mining and Manufacturing Co.). The fixation test is performed in the temperature range of 100°–250° C. under temperature control while changing the temperature at an increment of 5° C. each.

The fixability is evaluated by rubbing a fixed toner image (non-offset toner image) twice with a lens cleaning paper ("Dasper (R)", mfd. by Ozu Paper, Co., Ltd.) at a load of 50 g/cm$^2$, and the fixability is evaluated in terms of a fixing initiation temperature $T_{FI}$ (°C.) at or above which the density decrease of the image after the rubbing is below 10%.

The anti-offset characteristic is evaluated in terms a lower limit temperature (lower offset initiation temperature) (Low-temp. $T_{non-off}$) at or above which offset is unobservable and a higher limit temperature (higher offset terminating temperature) (High-temp. $T_{non-off}$) at or below which offset is unobservable, respectively by eye observation.

Transparency

The transmittance and haze are measured with respect to fixed toner images formed on an OHP sheet at varying toner weights per unit area, and the transparency is evaluated by the transmittance Tp [%] and haze [–] at a toner weight per unit area of 0.70 mg/cm$^2$. The transmittance Tp [%] and haze [–] may be measured in the following manner.

The transmittance Tp [%] of an OHP image is measured relative to that of an OHP sheet per se as Tp=100% by using an auto-recording spectrophotometer ("UV2200", mfd. by Shimazu Seisakusho K.K.) at maximum absorption wavelengths for the respective toners (i.e., 550 nm for a magenta toner, 650 nm for a cyan toner, and 410 nm for a yellow toner).

The haze [–] may be measured by using a haze meter ("NDH-300A", mfd. by Nippon Hasshoku Kogyo K.K.).

Hereinbelow, the present invention will be described in detailed based on Synthetic Examples and Examples.

Comparative Synthesis Example 1 of Polyester Resin

| | |
|---|---|
| Terephthalic acid | 46 mol. % |
| Bisphenol derivative (Etherified Bisphenol A) of the above-described formula (A) (R = propylene, x + y = about 2) | 54 mol. % |

The above mixture and a catalyst amount of dibutyltin oxide and hydroquinone were placed in a four-neck flask equipped with a thermometer, a stirrer, a reflux condenser and a nitrogen-introducing pipe. The flask was gradually heated to 200° C. while introducing nitrogen gas therein to effect polycondensation (of dicarboxylic acid and diol). The reaction product was gradually cooled after it showed an acid value of about 2.5 (mgKOH/g) to obtain a linear Comparative polyester resin No. 1.

The thus obtained Comparative polyester resin No. 1 showed an acid value of 2.0 mgKOH/g, an OH value of 27.0 mgKOH, an Mw of 11,700 (by GPC), an Mn of 5,500 (by GPC), a glass transition point (Tg) of 69° C., and an Mn (cal.) of 3,870 (by end-group analysis).

Synthesis Example 1 of Polyester Resin 100 wt. parts of Comparative polyester resin No. 1 was placed in a four-neck flask and heated to 150° C. To the heated resin, 1.7 wt. parts of trimellitic anhydride was added and gradually heated to prepare Modified polyester resin No. 1 modified with trimellitic acid at a polymer terminal portion of Comparative polyester resin No. 1.

The thus prepared Modified polyester resin No. 1 showed the following physical properties:

Acid value: 9.5 mgKOH/g

OH value: 22.0 mgKOH/g

Mw: 12,000

Mn: 5,700

Tg: 70° C.

Mn (cal.): 3,560

Comparative Synthesis Example 2 of Polyester Resin

Comparative polyester resin No. 2 having the physical properties shown below was prepared in the same manner as in Comparative Synthesis Example 1.

Acid value: 9.5 mgKOH/g

OH value: 19 mgKOH/g

Mw: 12,200

Mn: 5,800

Tg: 70° C.

Mn (cal.): 3,900

Comparative Synthesis Example 3 of Polyester Resin

Comparative polyester resin No. 3 having the physical properties shown below was prepared in the same manner as in Synthesis Example 1 except that succinic anhydride (dicarboxylic anhydride) was used instead of trimellitic anhydride.

Acid value: 3.7 mgKOH/g

OH value: 21 mgKOH/g

Mw: 11,000

Mn: 5,300

Tg: 69° C.

Mn (cal.): 4,540

Comparative Synthesis Example 4 of Polyester Resin

Comparative polyester resin No. 4 having the physical properties shown below was prepared in the same manner as in Synthesis Example 1 except that the mixing ratio of terephthalic acid, etherified Bisphenol A and trimellitic anhydride.

Acid value: 2.1 mgKOH/g

OH value: 26 mgKOH/g

Mw: 14,800

Mn: 6,170

Tg: 77° C.

Mn (cal.): 3,990

Comparative Synthesis Example 5 of Polyester Resin

Comparative polyester resin No. 5 having the physical properties shown below was prepared in the same manner as in Synthesis Example 1 except that the mixing ratio of terephthalic acid, etherified Bisphenol A and trimellitic anhydride.

Acid value: 36.0 mgKOH/g

OH value: 15.5 mgKOH/g

Mw: 13,000

Mn: 5,500

Tg: 71° C.

Mn (cal.): 2,180

Synthesis Examples 2–9 of Polyester Resins

Linear polyester resins were prepared in the same manner as in Comparative Synthesis Example 1. The polyester resins were modified with trimellitic anhydride (pyromellitic anhydride for Synthesis Example 9) in the same manner as in Synthesis Example 1 to prepared Modified polyester resins No. 2–9 having the physical properties shown in Table 1 (including those of Modified polyester resin No. 1), respectively.

TABLE 1

(Physical Properties of Modified Polyester Resins)

| | Before modificatoin | | | | | | | |
|---|---|---|---|---|---|---|---|---|
| Modified polyester resin No. | Acid value (mg KOH/g) | OH value (mg KOH/g) | Mw | Mn | Mw/Mn | Tg (°C.) | Mn (cal.) | Mn – Mn (cal.) |
| 1 | 2.0 | 27.0 | 11700 | 5500 | 2.1 | 69 | 3870 | 1630 |
| 2 | 3.0 | 26.0 | 12000 | 5400 | 2.2 | 70 | 3870 | 1530 |
| 3 | 3.5 | 28.0 | 10500 | 4500 | 2.3 | 68 | 3560 | 940 |
| 4 | 2.5 | 29.0 | 9200 | 3650 | 2.5 | 63 | 3560 | 90 |
| 5 | 2.4 | 27.5 | 14500 | 5800 | 2.5 | 89 | 3750 | 2050 |
| 6 | 3.5 | 23.7 | 52000 | 26000 | 2.0 | 75 | 4130 | 21870 |
| 7 | 2.4 | 35.0 | 5500 | 4000 | 1.4 | 65 | 3000 | 1000 |
| 8 | 1.9 | 27.2 | 39650 | 6500 | 6.1 | 74 | 3860 | 2640 |
| 9*[1] | 2.1 | 26.9 | 11800 | 5700 | 2.1 | 70 | 3870 | 1830 |

| | After modificatoin | | | | | | | |
|---|---|---|---|---|---|---|---|---|
| Modified polyester resin No. | Acid value (mg KOH/g) | OH value (mg KOH/g) | Mw | Mn | Mw/Mn | Tg (°C.) | Mn (cal.) | Mn – Mn (cal.) |
| 1 | 9.5 | 22.0 | 12000 | 5700 | 2.1 | 70 | 3560 | 2140 |
| 2 | 7.5 | 23.0 | 13000 | 5600 | 2.3 | 71 | 3680 | 1920 |
| 3 | 8.5 | 25.0 | 1150 | 4450 | 2.5 | 69 | 3250 | 1200 |
| 4 | 10.0 | 24.0 | 9500 | 3750 | 2.5 | 64 | 3300 | 450 |
| 5 | 10.2 | 21.5 | 15000 | 6000 | 2.5 | 91 | 3540 | 2460 |
| 6 | 11.6 | 20.4 | 56000 | 26500 | 2.1 | 78 | 3510 | 22990 |
| 7 | 15.9 | 28.0 | 5800 | 4500 | 1.3 | 66 | 2560 | 1940 |
| 8 | 9.9 | 20.8 | 41480 | 6800 | 6.1 | 76 | 3650 | 3150 |
| 8 | 9.9 | 20.8 | 41480 | 6800 | 6.1 | 76 | 3650 | 3150 |
| 9*[1] | 9.8 | 20.4 | 12100 | 5800 | 2.1 | 72 | 3720 | 2080 |

*[1]Polyester resin No. 9 was modified with pyromellitic anhydride.

Comparative Synthesis Example 6 of Polyester Resin

| | |
|---|---|
| Terephthalic acid | 44 mol. % |
| Bisphenol derivative (Etherified Bisphenol A) of the above-described formula (A) (R = propylene, x + y = about 2) | 54 mol. % |
| Trimellitic acid | 2 mol. % |

Linear Comparative polyester resin No. 6 was prepared in the same manner as in Comparative Synthesis Example 1 except that the above ingredients were placed in a four-neck flask and subjected to polycondensation.

Comparative polyester resin No. 6 showed the physical properties shown in Table 2 (including those of Comparative polyester resins Nos. 1–5).

TABLE 2

(Physical Properties of Comparative Polyester Resins)

| Comparative polyester resin No. | Before modification | | | | | | | |
|---|---|---|---|---|---|---|---|---|
| | Acid value (mg KOH/g) | OH value (mg KOH/g) | Mw | Mn | Mw/Mn | Tg (°C.) | Mn (cal.) | Mn – Mn (cal.) |
| 1 | 2.0 | 27.0 | 11700 | 5500 | 2.1 | 69 | 3870 | 1630 |
| 2 | 9.5 | 19.0 | 12200 | 5800 | 2.1 | 70 | 3900 | 1900 |
| 3 | 2.0 | 27.0 | 11700 | 5500 | 2.1 | 69 | 3870 | 1630 |
| 4 | 1.9 | 27.2 | 14500 | 6000 | 2.4 | 77 | 3860 | 2140 |
| 5 | 25.0 | 20.5 | 12000 | 5400 | 2.2 | 70 | 2470 | 2930 |
| 6 | 2.0 | 27.0 | 20500 | 5000 | 4.1 | 69 | 1130 | 3870 |
| Comparative polyester resin No. | After modification | | | | | | | |
| | Acid value (mg KOH/g) | OH value (mg KOH/g) | Mw | Mn | Mw/Mn | Tg (°C.) | Mn (cal.) | Mn – Mn (cal.) |
| 1 | — | — | — | — | — | — | — | — |
| 2 | — | — | — | — | — | — | — | — |
| 3 | 3.7 | 21.0 | 11000 | 5300 | 2.1 | 69 | 4540 | 760 |
| 4 | 2.1 | 26 | 14800 | 6170 | 2.4 | 77 | 3990 | 2180 |
| 5 | 36.0 | 15.5 | 13000 | 5500 | 2.4 | 71 | 2180 | 3320 |
| 6 | — | — | — | — | — | — | — | — |

EXAMPLE 1

Into 750 wt. parts of deionized water in a reaction vessel, 500 wt. parts of 0.1M-$Na_3PO_4$ aqueous solution was added, and the system was warmed at 65° C. and stirred at 12000 rpm by a TK-type homomixer (available from Tokushu Kika Kogyo K.K.). To the system, 85 wt. parts of 1.5M-$CaCl_2$ aqueous solution was gradually added to form an aqueous medium containing $Ca_3(PO_4)_2$.

| | |
|---|---|
| Styrene | 165 wt. parts |
| n-Butyl acrylate | 34 wt. parts |
| Colorant (C.I. Pigment Blue 15:3) | 13 wt. parts |
| Polar resin (Modified polyester resin No. 1) | 15 wt. parts |
| Negative charge control agent (di-ti-butylsalicylic acid aluminum compound) | 3 wt. parts |
| Release agent (Ester wax No. 1 shown in Table 4) | 40 wt. parts |
| Crosslinking agent (divinylbenzene) | 0.4 wt. part |

The above ingredients were warmed at 65° C. in another vessel and subjected to uniform dissolution and dispersion by using a TK-type homomixer at 12,000 rpm. To the mixture, 12 wt. parts of 2,2'-azobis(2,4-dimethylvaleronitrile) (polymerization initiator) to prepare a polymerizable monomer composition.

The polymerizable monomer composition was charged in the above-prepared aqueous medium placed in the reaction vessel, and the system was stirred by a TK-type homomixer at 10,000 rpm for 5 min. at 65° C. in an $N_2$ environment to form particles of the polymerizable monomer composition dispersed in the aqueous medium. Then, the system was continually stirred by a paddle stirring blade and heated at 65° C. for 6 hours of reaction and further heated at 85° C. for 10 hours of reaction. After completion of the polymerization reaction, the system was cooled and hydrochloric acid was added thereto to dissolve the calcium phosphate. Then, the polymerizate was recovered by filtration, washed with water and dried to obtain cyan toner particles.

Figure 2:
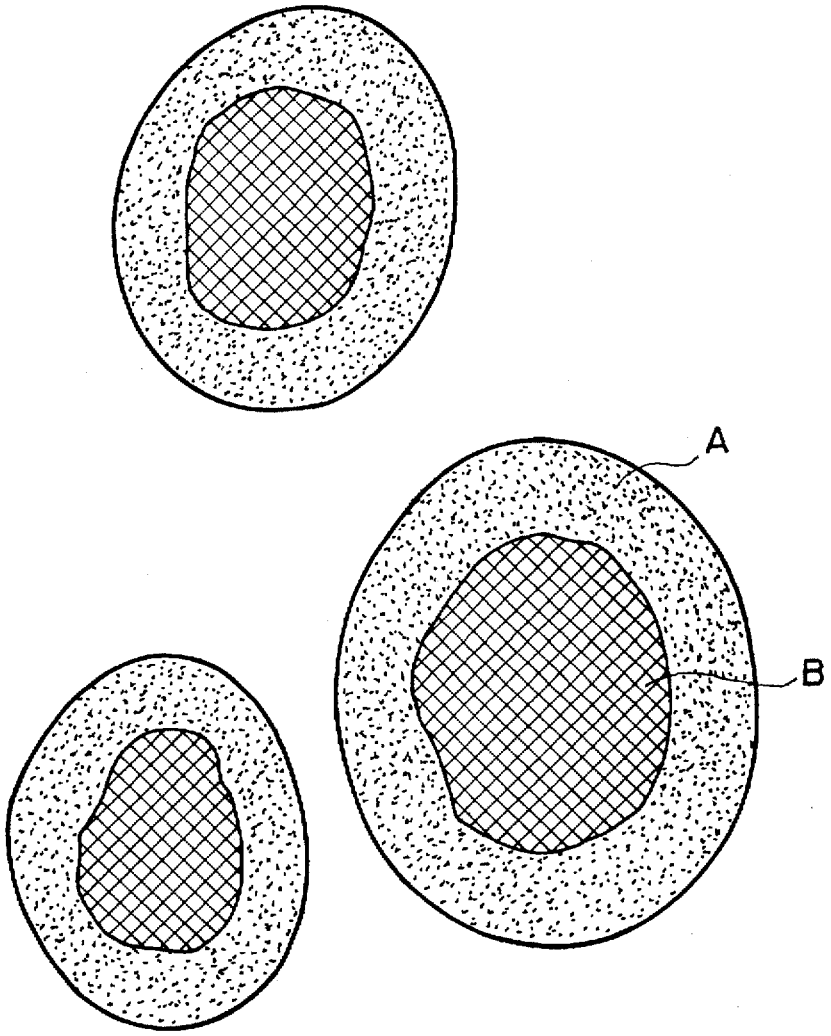
FIG. 2 is a schematic sectional view of toner particles each enclosing a release agent B within an outer resin A.

As a result of transmission electron microscope (TEM) observation of section, the resultant cyan toner particles showed a structure as shown in FIG. 2 wherein the release agent B was coated with the outer shell resin A.

The cyan toner particles contained about 7.5 wt. parts of the polar resin (Modified polyester resin No. 1) and about 20 wt. parts of the release agent (Ester wax No. 1) per 100 wt. parts of the binder resin (styrene-n-butyl acrylate copolymer).

To 100 wt. parts of the cyan toner particles, 1.5 wt. parts of hydrophobic titanium oxide fine powder ($S_{BET}$ (BET specific surface area)=100 $m^2/g$) was added to obtain negatively (triboelectric) chargeable Cyan toner No. 1, which showed a weight-average particle size ($D_4$)=6.4 μm and other physical properties shown in Table 3 appearing hereinbelow.

The above-prepared Cyan toner No. 1 was charged in a commercially available full-color digital copying apparatus ("CLC500", available from Canon K.K.) remodeled so as to include a developing device for non-magnetic mono-component development a shown in FIG. 9 instead of developing devices for respective colors, and was subjected to successive image formation.

Referring to FIG. 9, a developing sleeve 94 comprised an aluminum cylinder (dia.=0.20 mm) and a toner application roller 92 comprised an elastic roller (dia.=16 mm) including a core metal and a soft polyurethane foam layer disposed thereon. A toner-regulating member 93 comprised an elastic blade including a phosphorus bronze base plate, an urethane rubber layer attached thereto, and a nylon resin layer in contact with the developing sleeve 94.

The developing operation was performed by rotating the developing sleeve 94 in the direction of an arrow (counterclockwise direction) at a peripheral speed of 103 mm/sec, the toner coating roller 92 in the clockwise direction at a peripheral speed of 55 mm/sec, and an OPC photosensitive drum as a latent image-bearing member 95 in the direction of an arrow (clockwise direction) at a peripheral speed 60 mm/sec while supplying a developing bias including a C bias of −300 V, an AC bias (Vpp) of 1800 V and a frequency of 2000 Hz to the developing sleeve 94 by means of a bias (voltage) supply 96, whereby respective characteristics were evaluated.

The results are shown in Tables 5-1 to 5-5.

Further, toner application irregularity resulting from formation of toner particle agglomeration between the elastic blade 93 and the developing sleeve 94 was evaluated as follows.

After terminating the rotation of the OPC photosensitive drum 95 so as not to consume toner particles on the developing sleeve 94 by the development of an electrostatic image, the developing sleeve 94 and the toner application roller 92 were rotated to observe a surface state of the toner layer on the developing sleeve 94 by eyes with time.

Cyan toner No. 1 did not cause an irregularity in toner application (uneven toner layer) on the developing sleeve 94 even after 10,000 revolutions of the developing sleeve 94.

EXAMPLES 2–9

Cyan toners Nos. 2–9 were prepared and evaluated in the same manner as in Example 1 except that the polar resin (Modified polyester resin No. 1) was changed to Modified polyester resins Nos. 2–9, respectively.

The respective Cyan toners Nos. 2–9 provided the physical properties shown in Table 3 and evaluation results shown in Tables 5-1 to 5-5.

Comparative Examples 1–6

Comparative cyan toners Nos. 1–6 were prepared and evaluated in the same manner as in Example 1 except that the polar resin was changed to Comparative polyester resins Nos. 1–6, respectively.

The respective Comparative cyan toners Nos. 1–6 provided the physical properties shown in Table 3 and evaluation results shown in Tables 5-1 to 5-5.

EXAMPLES 10–15

Cyan toners Nos. 10–15 were prepared and evaluated in the same manner as in Example 1 except that the release agent (Ester wax No. 1) was changed to those shown in Table 4, respectively.

The respective Cyan toners Nos. 10–15 provided the physical properties shown in Table 3 and evaluation results shown in Tables 5-1 to 5-5.

TABLE 3

| Toner | $D_4$ (μm) | Coefficient of variation (%) | Agglomerability (%) | Toluene-insoluble content (%) | SF-1 | Triboelectric charge (mC/kg) NT/NH (23° C., 60% RH) | HT/HH (30° C., 80% RH) | LT/LH (15° C., 10% RH) |
|---|---|---|---|---|---|---|---|---|
| Cyan toner No. | | | | | | | | |
| 1 | 6.5 | 27 | 5.0 | 15.6 | 113 | −40 | −30 | −55 |
| 2 | 6.5 | 27 | 5.5 | 15.3 | 112 | −37 | −26 | −52 |
| 3 | 6.7 | 28 | 5.7 | 16.2 | 115 | −39 | −27 | −54 |
| 4 | 6.6 | 26 | 6.1 | 15.4 | 117 | −42 | −31 | −57 |
| 5 | 6.8 | 27 | 5.5 | 16.7 | 112 | −43 | −33 | −58 |
| 6 | 6.4 | 28 | 5.8 | 16.3 | 113 | −44 | −34 | −58 |
| 7 | 6.3 | 29 | 7.1 | 15.9 | 121 | −45 | −33 | −62 |
| 8 | 6.9 | 26 | 7.8 | 16.3 | 120 | −42 | −31 | −58 |
| 9 | 6.5 | 27 | 8.1 | 16.6 | 121 | −41 | −30 | −58 |
| 10 | 6.4 | 28 | 7.2 | 16.9 | 114 | −40 | −30 | −55 |
| 11 | 6.5 | 29 | 6.8 | 15.7 | 113 | −41 | −29 | −56 |
| 12 | 6.6 | 26 | 5.9 | 17.1 | 111 | −40 | −28 | −56 |
| 13 | 6.7 | 28 | 13.1 | 16.8 | 126 | −38 | −27 | −54 |
| 14 | 6.9 | 29 | 23.7 | 16.2 | 127 | −37 | −26 | −53 |
| 15 | 6.9 | 29 | 27.4 | 16.1 | 128 | −38 | −27 | −54 |
| Comp. cyan toner No. | | | | | | | | |
| 1 | 8.1 | 45 | 31.1 | 17.1 | 138 | −20 | −8 | −31 |
| 2 | 7.8 | 59 | 41.8 | 16.1 | 133 | −41 | −30 | −60 |
| 3 | 6.0 | 58 | 45.7 | 16.5 | 140 | −30 | −29 | −46 |
| 4 | 8.4 | 44 | 33.1 | 16.2 | 131 | −19 | −7 | −30 |
| 5 | 8.6 | 48 | 38.5 | 16.8 | 138 | −55 | −40 | −79 |
| 6 | 8.9 | 47 | 36.7 | 16.8 | 136 | −18 | −6 | −29 |

TABLE 4

| Release agent | Composition | Mw | Mn | Melting point (°C.) | Viscosity (cPs) | Value |
|---|---|---|---|---|---|---|
| Ester wax No. 1 (Ex. 1) | Release agent No. 5* | 650 | 540 | 73 | 3.8 | 8.6 |
| Ester wax No. 2 (Ex. 10) | Release agent No. 11* | 850 | 710 | 80 | 3.8 | 8.8 |
| Ester wax No. 3 (Ex. 11) | Release agent No. 12* | 690 | 580 | 75 | 3.6 | 8.8 |
| Ester wax No. 4 (Ex. 12) | Release agent No. 1* | 850 | 710 | 71 | 3.7 | 9.1 |
| Paraffin wax (Ex. 13) | PF-155 (mfd. by Nippon Seiro K.K.) | 800 | 500 | 70 | 5.6 | 8.3 |
| Polyethylene wax (Ex. 14) | PE130 (mfd. by Hoechst AG) | 6000 | 1200 | 125 | 50 | 8.4 |
| Polypropylene wax (Ex. 15) | Viscol 550P (mfd. by Sanyo Kasei Kogyo K.K.) | 14000 | 4600 | 139 | 560 | 8.4 |

*These release agents (Nos. 5, 11, 12, 1) were used as principal component.

TABLE 5-1

| Ex. or Comp. Ex. | Toner | $T_{FI}$ (°C.) | Low-temp. $T_{non-off}$ (°C.) | High-temp. $T_{non-off}$ (°C.) | Fixed image on OHP film Transmittance (%) | Haze |
|---|---|---|---|---|---|---|
| Ex. | Cyan toner No. | | | | | |
| 1 | 1 | 150 | 150 | 230 | 70 | 22 |
| 2 | 2 | 150 | 150 | 230 | 70 | 23 |
| 3 | 3 | 150 | 150 | 230 | 68 | 22 |
| 4 | 4 | 150 | 150 | 230 | 68 | 23 |
| 5 | 5 | 165 | 165 | 240 | 67 | 24 |
| 6 | 6 | 150 | 155 | 235 | 66 | 23 |
| 7 | 7 | 150 | 150 | 230 | 65 | 23 |
| 8 | 8 | 150 | 150 | 230 | 67 | 23 |
| 9 | 9 | 150 | 150 | 230 | 68 | 21 |
| 10 | 10 | 150 | 150 | 230 | 67 | 24 |
| 11 | 11 | 150 | 150 | 230 | 65 | 22 |
| 12 | 12 | 150 | 150 | 230 | 68 | 25 |
| 13 | 13 | 150 | 150 | 230 | 51 | 40 |
| 14 | 14 | 150 | 155 | 240 | 43 | 48 |
| 15 | 15 | 150 | 160 | 245 | 40 | 53 |
| Comp. Ex. 1 | Comp. cyan toner No. | | | | | |
| 1 | 1 | 150 | 150 | 210 | 68 | 21 |
| 2 | 2 | 150 | 150 | 200 | 66 | 24 |
| 3 | 3 | 150 | 150 | 200 | 65 | 22 |
| 4 | 4 | 150 | 150 | 210 | 67 | 24 |
| 5 | 5 | 150 | 150 | 210 | 64 | 23 |
| 6 | 6 | 150 | 150 | 210 | 68 | 21 |

TABLE 5-2

| Ex. or Comp. Ex. | Toner | In NT/NH (23° C./60% RH) Environment: Occurrence of toner application irregularity on developing sleeve after prescribed revolutions 1000 rev. | 3000 rev. | 6000 rev. | 8000 rev. | 10000 rev. |
|---|---|---|---|---|---|---|
| Ex. 1 | Comp. Cyan toner No. | | | | | |
| 1 | 1 | No | No | No | No | No |
| 2 | 2 | No | No | No | No | No |

TABLE 5-2-continued

| In NT/NH (23° C./60% RH) Environment | | | | | | |
|---|---|---|---|---|---|---|
| Ex. or | | Occurrence of toner application irregularity on developing sleeve after prescribed revolutions | | | | |
| Comp. Ex. | Toner | 1000 rev. | 3000 rev. | 6000 rev. | 8000 rev. | 10000 rev. |
| 3 | 3 | No | No | No | No | No |
| 4 | 4 | No | No | No | No | Yes |
| 5 | 5 | No | No | No | No | No |
| 6 | 6 | No | No | No | No | Yes |
| 7 | 7 | No | No | No | No | No |
| 8 | 8 | No | No | No | No | Yes |
| 9 | 9 | No | No | No | No | No |
| 10 | 10 | No | No | No | No | No |
| 11 | 11 | No | No | No | No | No |
| 12 | 12 | No | No | No | No | No |
| 13 | 13 | No | No | No | Yes | — |
| 14 | 14 | No | No | No | Yes | — |
| 15 | 15 | No | No | No | Yes | — |
| Comp. Ex. 1 | Comp. cyan toner No. | | | | | |
| 1 | 1 | Yes | — | — | — | — |
| 2 | 2 | No | Yes | — | — | — |
| 3 | 3 | No | Yes | — | — | — |
| 4 | 4 | Yes | — | — | — | — |
| 5 | 5 | No | Yes | — | — | — |
| 6 | 6 | Yes | — | — | — | — |

TABLE 5-3

| In NT/NH (23° C./60% RH) Environment | | | | | | | | | | | |
|---|---|---|---|---|---|---|---|---|---|---|---|
| | | Initial stage | | | | | After 20000 sheets | | | | |
| Ex. or Comp. Ex. | Toner | Image density | Halftone image | Solid image | Fog (%) | $TC_{sleeve}$ (mC/kg) | Image density | Halftone image | Solid image | Fog (%) | $TC_{sleeve}$ (mC/kg) |
| Ex. 1 | Cyan toner No. | | | | | | | | | | |
| 1 | 1 | 1.55 | A | A | A | −25 | 1.55 | A | A | A | −24 |
| 2 | 2 | 1.54 | A | A | A | −23 | 1.54 | A | A | A | −22 |
| 3 | 3 | 1.53 | A | A | A | −24 | 1.53 | A | A | A | −23 |
| 4 | 4 | 1.53 | A | A | A | −26 | 1.52 | A | A | B | −24 |
| 5 | 5 | 1.54 | A | A | A | −27 | 1.52 | A | A | B | −25 |
| 6 | 6 | 1.51 | A | A | A | −27 | 1.50 | A | A | B | −25 |
| 7 | 7 | 1.53 | A | A | A | −26 | 1.52 | A | A | B | −23 |
| 8 | 8 | 1.52 | A | A | A | −25 | 1.51 | A | A | B | −22 |
| 9 | 9 | 1.54 | A | A | A | −24 | 1.53 | A | A | B | −22 |
| 10 | 10 | 1.52 | A | A | A | −25 | 1.51 | A | A | B | −22 |
| 11 | 11 | 1.52 | A | A | A | −24 | 1.51 | A | A | B | −21 |
| 12 | 12 | 1.52 | A | A | A | −23 | 1.51 | A | A | B | −20 |
| 13 | 13 | 1.50 | A | A | B | −23 | 1.50 | A | A | B | −20 |
| 14 | 14 | 1.50 | A | A | B | −23 | 1.50 | A | A | B | −20 |
| 15 | 15 | 1.49 | A | A | B | −22 | 1.49 | A | A | B | −20 |
| Comp. Ex. 1 | Comp. cyan toner No. | | | | | | | | | | |
| 1 | 1 | 1.43 | C | C | C | −15 | 1.45 | D | D | D | −11 |
| 2 | 2 | 1.40 | B | B | B | −18 | 1.30 | C | C | C | −25 |
| 3 | 3 | 1.38 | B | B | B | −19 | 1.42 | C | C | C | −12 |
| 4 | 4 | 1.33 | C | C | C | −14 | 1.38 | D | D | D | −10 |
| 5 | 5 | 1.38 | B | B | B | −18 | 1.21 | C | C | C | −26 |
| 6 | 6 | 1.31 | C | C | C | −14 | 1.37 | D | D | D | −10 |

TABLE 5-4

In HT/NH (30° C./80% RH) Environment

| Ex. or Comp. Ex. | Toner | Initial stage: Image density | Halftone image | Solid image | Fog (%) | $TC_{sleeve}$ (mC/kg) | After 20000 sheets: Image density | Halftone image | Solid image | Fog (%) | $TC_{sleeve}$ (mC/kg) |
|---|---|---|---|---|---|---|---|---|---|---|---|
| Ex. 1 | Cyan toner No. | | | | | | | | | | |
| 1 | 1 | 1.55 | A | A | A | −15 | 1.56 | A | A | A | −14 |
| 2 | 2 | 1.54 | A | A | A | −14 | 1.55 | A | A | A | −13 |
| 3 | 3 | 1.53 | A | A | A | −14 | 1.54 | A | A | A | −13 |
| 4 | 4 | 1.53 | A | A | A | −16 | 1.54 | A | A | B | −14 |
| 5 | 5 | 1.54 | A | A | A | −17 | 1.55 | A | A | B | −15 |
| 6 | 6 | 1.51 | A | A | A | −17 | 1.52 | A | A | B | −15 |
| 7 | 7 | 1.53 | A | A | A | −16 | 1.54 | A | A | B | −13 |
| 8 | 8 | 1.52 | A | A | A | −15 | 1.53 | A | A | B | −13 |
| 9 | 9 | 1.54 | A | A | A | −14 | 1.55 | A | A | B | −12 |
| 10 | 10 | 1.52 | A | A | A | −15 | 1.53 | A | A | B | −13 |
| 11 | 11 | 1.52 | A | A | A | −14 | 1.53 | A | A | B | −11 |
| 12 | 12 | 1.52 | A | A | A | −13 | 1.53 | A | A | B | −11 |
| 13 | 13 | 1.50 | A | A | B | −13 | 1.51 | A | A | B | −11 |
| 14 | 14 | 1.50 | A | A | B | −13 | 1.51 | A | A | B | −11 |
| 15 | 15 | 1.49 | A | A | B | −13 | 1.50 | A | A | B | −11 |
| Comp. Ex. 1 | Comp. cyan toner No. | | | | | | | | | | |
| 1 | 1 | 1.03 | D | D | D | −8 | 1.08 | D | D | D | −4 |
| 2 | 2 | 1.18 | C | C | B | −11 | 1.23 | D | D | C | −9 |
| 3 | 3 | 1.17 | C | C | C | −10 | 1.22 | D | D | C | −9 |
| 4 | 4 | 1.10 | D | D | D | −7 | 1.17 | D | D | D | −3 |
| 5 | 5 | 1.20 | C | C | B | −11 | 1.24 | D | D | C | −9 |
| 6 | 6 | 1.01 | D | D | D | −6 | 1.10 | D | D | D | −2 |

TABLE 5-5

In LT/LH (15° C./10% RH) Environment

| Ex. or Comp. Ex. | Toner | Initial stage: Image density | Halftone image | Solid image | Fog (%) | $TC_{sleeve}$ (mC/kg) | After 20000 sheets: Image density | Halftone image | Solid image | Fog (%) | $TC_{sleeve}$ (mC/kg) |
|---|---|---|---|---|---|---|---|---|---|---|---|
| Ex. 1 | Cyan toner No. | | | | | | | | | | |
| 1 | 1 | 1.55 | A | A | A | −33 | 1.55 | A | A | A | −34 |
| 2 | 2 | 1.54 | A | A | A | −31 | 1.54 | A | A | A | −32 |
| 3 | 3 | 1.53 | A | A | A | −31 | 1.53 | A | A | A | −32 |
| 4 | 4 | 1.53 | A | A | A | −33 | 1.52 | A | A | B | −35 |
| 5 | 5 | 1.54 | A | A | A | −34 | 1.53 | A | A | B | −36 |
| 6 | 6 | 1.51 | A | A | A | −34 | 1.51 | A | A | B | −36 |
| 7 | 7 | 1.53 | A | A | A | −33 | 1.52 | A | A | B | −35 |
| 8 | 8 | 1.52 | A | A | A | −32 | 1.51 | A | A | B | −35 |
| 9 | 9 | 1.54 | A | A | A | −32 | 1.53 | A | A | B | −35 |
| 10 | 10 | 1.52 | A | A | A | −31 | 1.51 | A | A | B | −34 |
| 11 | 11 | 1.52 | A | A | A | −31 | 1.51 | A | A | B | −34 |
| 12 | 12 | 1.52 | A | A | A | −31 | 1.51 | A | A | B | −34 |
| 13 | 13 | 1.50 | A | A | B | −30 | 1.50 | A | A | B | −33 |
| 14 | 14 | 1.50 | A | A | B | −30 | 1.49 | A | A | B | −33 |
| 15 | 15 | 1.49 | A | A | B | −30 | 1.49 | A | A | B | −33 |
| Comp. Ex. 1 | Comp. cyan toner No. | | | | | | | | | | |
| 1 | 1 | 1.20 | D | D | D | −25 | 1.23 | C | C | D | −18 |
| 2 | 2 | 0.87 | C | C | C | −50 | 0.51 | D | D | D | −80 |
| 3 | 3 | 1.18 | C | C | C | −26 | 1.24 | C | C | D | −17 |
| 4 | 4 | 1.21 | D | D | D | −26 | 1.25 | C | C | D | −18 |
| 5 | 5 | 0.93 | C | C | C | −51 | 0.43 | D | D | D | −87 |
| 6 | 6 | 1.18 | C | C | C | −27 | 1.21 | C | C | D | −18 |

EXAMPLES 16–18

Yellow toner, Magenta toner and Black toner were prepared in the same manner as in Example 1 except for using C.I. Pigment Yellow 17, C.I. Pigment Red 202, and grafted carbon black, respectively, instead of the colorant (C.I. Pigment Blue 15:3). The respective toners showed the physical properties shown in Table 6.

7 wt. parts of each of the above respective toners and Cyan toner No. 1 and 93 wt. parts of silicone resin-coated magnetic ferrite carrier were blended to prepare a two-component type developer.

The two-component type developers were incorporated in a commercially available full-color copying apparatus ("CLC500", available from Canon K.K.) (remodeled type) and subjected to evaluation tests in a full-color mode while appropriately supplying the respective color toners in a normal temperature/normal humidity (NT/NH) environment (23° C./60% RH).

As a result, a good full-color fixed image substantially identical to an original full-color image was obtained.

The evaluation results are shown in Tables 7 and 8.

Comparative Examples 7–9

Comparative yellow toner, Comparative magenta toner and Comparative black toner were prepared and evaluated in the same manner as in Examples 16–18 except that the polar resin (Modified polyester resin No. 1) was changed to Comparative polyester resin No. 1 and Comparative cyan toner No. 1 was used for preparing a two-component type developer for cyan color.

The evaluation results are shown in Tables 7 and 8.

Compared with the respective color toners according to the present invention, the comparative color toners provided fixed images inferior in reproducibility of original images.

TABLE 6

| Toner | $D_4$ (μm) | Coefficient of variation (%) | Agglomerability (%) | Toluene-insolube content (%) | SF-1 | Triboelectric charge (mC/kg) NT/NH (23° C., 60% RH) | HT/HH (30° C., 80% RH) | LT/LH (15° C., 10% RH) |
|---|---|---|---|---|---|---|---|---|
| Yellow toner | 6.5 | 27 | 4.9 | 15.7 | 110 | −37 | −27 | −50 |
| Magenta toner | 6.5 | 26 | 5.1 | 15.5 | 112 | −40 | −31 | −54 |
| Black toner | 6.5 | 22 | 5.0 | 15.0 | 109 | −35 | −26 | −51 |
| Comp. yellow toner | 8.1 | 33 | 31.0 | 17.1 | 138 | −20 | −8 | −31 |
| Comp. magenta toner | 8.2 | 46 | 32.0 | 16.8 | 133 | −21 | −7 | −30 |
| Comp. black toner | 8.3 | 44 | 33.3 | 17.5 | 137 | −20 | −8 | −31 |

TABLE 7

| Toner | $T_{FI}$ (°C.) | Low-temp. $T_{non\text{-}off}$ (°C.) | High-temp. $T_{non\text{-}off}$ (°C.) |
|---|---|---|---|
| Cyan toner No. 1 | 150 | 150 | 230 |
| Yellow toner | 150 | 150 | 230 |
| Magenta toner | 150 | 150 | 230 |
| Black toner | 150 | 150 | 230 |
| Comp. cyan toner No. 1 | 150 | 150 | 210 |
| Comp. yellow toner | 150 | 150 | 210 |
| Comp. magenta toner | 150 | 150 | 210 |
| Comp. black toner | 150 | 150 | 210 |

TABLE 8

| Toner | (Full-color mode; NT/NH (23° C./60% RH)) Initial stage Image density | Halftone image | Solid image | Fog (%) | After 5000 sheets Image density | Halftone image | Solid image | Fog (%) |
|---|---|---|---|---|---|---|---|---|
| Cyan toner No. 1 | 1.55 | A | A | A | 1.55 | A | A | A |
| Yellow toner | 1.55 | A | A | A | 1.55 | A | A | A |
| Magenta toner | 1.54 | A | A | A | 1.54 | A | A | A |
| Black toner | 1.54 | A | A | A | 1.54 | A | A | A |
| Comp. cyan toner No. 1 | 1.43 | C | C | C | 1.45 | D | D | D |
| Comp. yellow toner | 1.40 | C | C | C | 1.40 | D | D | D |
| Comp. magenta toner | 1.41 | C | C | C | 1.40 | D | D | D |
| Comp. black toner | 1.40 | C | C | C | 1.39 | D | D | D |

What is claimed is:

1. A toner for developing an electrostatic image, comprising toner particles wherein said toner particles comprise at least a binder resin, a colorant, a polar resin and a release agent;

wherein said polar resin has at least one terminal group which has been modified by a polycarboxylic acid having at least three carboxyl groups, said polar resin having an acid value of 3–35 mgKOH/g.

2. The toner according to claim 1, wherein said polar resin comprises a polyester resin.

3. The toner according to claim 2, wherein said polyester resin has an acid value of 4–35 mgKOH/g and has a number-average molecular weight (Mn) of 3,000–15,000, a weight-average molecular weight (Mw) of 6,000–50,000, and an Mw/Mn of 1.2–3.0 based on GPC.

4. The toner according to claim 3, wherein said polyester resin has a number-average molecular weight (Mw(cal.)) obtained from the following formula:

$$Mn(cal.)=56.108\times2000/[(\text{acid value of polyester resin})+(\text{OH value of polyester resin})],$$

Mn and Mn(cal.) providing a difference therebetween [Mn–Mn(cal.)] of at least 500.

5. The toner according to claim 3, wherein said polar resin comprises a polyester resin obtained from a diol having a bisphenol structure and a dicarboxylic acid.

6. The toner according to claim 3, wherein said polar resin comprises a polyester resin obtained from a bisphenol A-based diol, a dicarboxylic acid and a polycarboxylic acid.

7. The toner according to claim 1, wherein said binder resin comprises a polystyrene, a styrene copolymer or a mixture thereof.

8. The toner according to claim 1, wherein said binder resin comprises a styrene-acrylate copolymer.

9. The toner according to claim 1, wherein said binder resin comprises a styrene-methacrylate copolymer.

10. The toner according to claim 1, wherein said toner particles are formed by dispersing a polymerizable monomer composition comprising at least a polymerizable monomer, a colorant, a polar resin, a release agent, and a polymerization initiator in an aqueous medium, forming the polymerizable monomer composition into particles, and polymerizing the polymerizable monomer.

11. The toner according to claim 3, wherein said polyester resin has an acid value of 5–30 mgKOH/g.

12. The toner according to claim 3, wherein said polyester resin has an OH value of 5–50 mgKOH/g.

13. The toner according to claim 12, wherein said polyester resin has an OH value of 7–45 mgKOH/g.

14. The toner according to claim 3, wherein said polyester resin has an acid value of 5–30 mgKOH/g and an OH value of 7–45 mgKOH/g.

15. The toner according to claim 3, wherein said polyester resin has an Mn of 3,500–12,000, an Mw of 6,500–45,000, and an Mw/Mn of 1.5–2.5.

16. The toner according to claim 3, wherein said polyester resin has a main peak in a molecular weight region of 4,500–22,000 in a molecular weight distribution according to GPC.

17. The toner according to claim 16, wherein said polyester resin has a main peak in a molecular weight region of 6,000–20,000 in a molecular weight distribution according to GPC.

18. The toner according to claim 1, wherein said polar resin has a glass transition point (Tg) of 50°–95° C.

19. The toner according to claim 18, wherein said polar resin has a Tg of 55°–90° C.

20. The toner according to claim 1, wherein said polar resin has an acid value of 0.1–30 mgKOH/g and an OH value of 7–55 mgKOH/g, respectively, before the modification by the polycarboxylic acid.

21. The toner according to claim 20, wherein said polar resin has an acid value of 1.0–28 mgKOH/g and an OH value of 10–50 mgKOH/g, respectively, before the modification by the polycarboxylic acid.

22. The toner according to claim 1, wherein said polar resin comprises a polyester resin formed by modifying a linear polyester resin with a polycarboxylic acid having at least three carboxylic groups.

23. The toner according to claim 22, wherein said polyester resin has an MW/Mn of 1.2–3.0.

24. The toner according to claim 23, wherein said polyester resin has an Mw/Mn of 1.5–2.5.

25. The toner according to claim 22, wherein said polar resin comprises a polyester resin formed by modifying a linear polyester resin obtained from an esterified bisphenol A and a terephthalic acid with trimellitic anhydride or pyromellitic anhydride.

26. The toner according to claim 1, wherein said release agent has an Mw of 350–4,000 and an Mn of 200–4,000.

27. The toner according to claim 26, wherein said release agent has an Mw of 400–3,500 and an Mn of 250–3,500.

28. The toner according to claim 1, wherein said release agent has a melting point of 30°–120° C.

29. The toner according to claim 28, wherein said release agent has a melting point of 50°–90° C.

30. The toner according to claim 1, wherein said release agent comprises a solid wax.

31. The toner according to claim 30, wherein said release agent comprises a solid wax having a melting point of 50°–90° C.

32. The toner according to claim 1, wherein said release agent comprises a solid ester wax.

33. The according to claim 32, wherein said release agent comprises a solid ester wax having a melting point of 50°–90° C.

34. The toner according to claim 1, wherein said release agent comprises an ester wax selected from the group consisting of compounds represented by the following formulae (I)–(VI):

$$[R_1—COO—(CH_2)_n]_a—C—[(CH_2)_m—OCO—R_2]_b \quad (I),$$

wherein aand b independently denote an integer of 0–4 satisfying a+b=4; $R_1$ and $R_2$ independently denote an organic group having 1–40 carbon atoms, $R_1$ and $R_2$ providing a difference in carbon number of at least 3; and m and n independently denote an integer of –25 with the proviso that m and n are not 0 at the same time;

$$[R_1—COO—(CH_2)_n]_a—\overset{(R_3)_k}{\overset{|}{C}}—[(CH_2)_m—OCO—R_2]_b, \quad (II)$$

wherein aand b independently denote an integer of 0–3 satisfying a+b=1–3; $R_1$ and $R_2$ independently denote an organic group having 1–40 carbon atoms, $R_1$ and $R_2$ providing a difference in carbon number of at least 3; $R_3$ denotes hydrogen atom or an organic group having at least one carbon atom with the proviso that one of $R_3$ is an organic group having at least one carbon atom when a+b=2; k is an integer of 1–3; and m and n independently denote an integer of 0–25 with the proviso that m and n are not 0 at the same time;

$$R_1—OCO—R_2—COO—R_3 \quad (III),$$

wherein $R_1$ and $R_3$ independently denote an organic group having 6–32 carbon atoms, and $R_2$ denotes an organic group having 1–20 carbon atoms;

$$R_1—COO—R_2—OCO—R_3 \quad (IV),$$

wherein $R_1$ and $R_3$ independently denote an organic group having 6–32 carbon atoms; and $R_2$ denotes $—CH_2CH_2OC_6H_4OCH_2CH_2—$, $—(CH(CH_3)CH_2O)_m—C_6H_4C(CH_3)_2C_6H_4—(OCH_2CH(CH_3))_m—$ or $—(CH_2)_n—$ wherein m is an integer of 1–10 and n is an integer of 1–20;

$$[R_1—COO—(CH_2)_n]_a—C—[(CH_2)_m—OH]_b \quad (V),$$

wherein a is an integer of 0–4 and b is an integer of 1–4 satisfying a+b=4; $R_1$ denotes an organic group having 1–40 carbon atoms; and m and n independently denote an integer of 0–25 with the proviso that m and n are not 0 at the same time; and $$R_1—COO—R_2 \quad (VI),$$

wherein $R_1$ and $R_2$ independently denote a hydrocarbon group having 15–45 carbon atoms.

35. The toner according to claim 1, wherein said polar resin is contained in an amount of 0.1–25 wt. parts per 100 wt. parts of the binder resin and said release agent is contained in an amount of 5–40 wt. parts per 100 wt. parts of the binder resin.

36. The toner according to claim 35, wherein said polar resin is contained in an amount of 0.5–20 wt. parts per 100 wt. parts of the binder resin and said release agent is contained in an amount of 10–30 wt. parts per 100 wt. parts of the binder resin.

37. The toner according to claim 36, wherein said polar resin is contained in an amount of 1–15 wt. parts per 100 wt. parts of the binder resin.

38. The toner according to claim 1, which has a shape factor SF-1 of 100 to 150.

39. The toner according to claim 3, which has a shape factor SF-1 of 100 to 150.

40. The toner according to claim 1, which has a shape factor SF-1 of 100 to 125.

41. The toner according to claim 3, which has a shape factor SF-1 of 100 to 125.

42. A process for producing a toner containing toner particles, comprising:

dispersing a polymerizable monomer composition comprising at least a polymerizable monomer, a colorant, a polar resin, a release agent, and a polymerization initiator in an aqueous medium, forming the polymerizable monomer composition into particles, and polymerizing the polymerizable monomer to form the toner particles, wherein said polar resin has at least one terminal group which has been modified by a polycarboxylic acid having at least three carboxyl groups, said polar resin having an acid value of 3–35 mgKOH/g.

43. The process according to claim 42, wherein said toner is a toner according to any one of claims 2–41.

44. An image forming method comprising:

forming an electrostatic latent image on a photosensitive member;

developing said electrostatic latent image with a developer on a developing sleeve, while applying an alternating electric field to said developing sleeve to obtain a toner image on said photosensitive member, transferring said toner image onto a transfer-receiving member directly or via an intermediate transfer member; and hot-pressure fixing said toner image on said transfer-receiving member, wherein said toner comprises toner particles comprising at least a binder resin, a colorant, a polar resin and a release agent; and said polar resin has at least one terminal group which has been modified by a polycarboxylic acid having at least three carboxyl groups, said polar resin having an acid value of 3–35 mgKOH/g.

45. The image forming method according to claim 44, wherein said toner is a toner according to any one of claims 2–41.

* * * * *

UNITED STATES PATENT AND TRADEMARK OFFICE

CERTIFICATE OF CORRECTION

PATENT NO. : 5,750,303

DATED : May 12, 1998

INVENTOR(S) : KOHJI INABA, ET AL.

It is certified that error appears in the above-identified patent and that said Letters Patent is hereby corrected as shown below:

AT [57] ABSTRACT

Line 12, "having" should read --having been--.

COLUMN 2

Line 30, "desired" should read --a desire--;
Line 33, "becoming" should read --available--; and
Line 40, "forma" should read --form a--.

COLUMN 5

Line 1, "group." should read --groups.--.

COLUMN 6

Line 17, "3,0," should read --3.0,--.

COLUMN 7

Line 22, "an" should read --and--.

COLUMN 8

Line 31, "compound" should read --compound and--.

COLUMN 10

Line 5, "an" should read --a--;
Line 29, "larger" should read --larger than--;
Line 33, "an" should read --and an--; and
Line 62, "was" should read --wax--.

UNITED STATES PATENT AND TRADEMARK OFFICE

CERTIFICATE OF CORRECTION

PATENT NO. : 5,750,303

DATED : May 12, 1998

INVENTOR(S) : KOHJI INABA, ET AL.

It is certified that error appears in the above-identified patent and that said Letters Patent is hereby corrected as shown below:

COLUMN 11

Line 29, "relates" should read --release--; and
Line 55, "-25" should read --0-25--.

COLUMN 13

Line 32, "an" should read --and--; and
Line 62, "of" should be deleted.

COLUMN 16

Line 9, "toluene" should read --toluene.--.

COLUMN 17

Line 18, "used" should read --be used--.

COLUMN 24

Line 53, "to" should read --to realize--; and
Line 65, "roller 25 45" should read --roller 45--.

COLUMN 25

Line 42, "alone" should read --along--.

COLUMN 27

Line 26, "mean" should read --means--; and
Line 55, "performed" should read --be performed--.

UNITED STATES PATENT AND TRADEMARK OFFICE

CERTIFICATE OF CORRECTION

PATENT NO. : 5,750,303

DATED : May 12, 1998

INVENTOR(S) : KOHJI INABA, ET AL.

It is certified that error appears in the above-identified patent and that said Letters Patent is hereby corrected as shown below:

COLUMN 29

Line 3, "has" should read --have--; and
Line 34, "roller 77" should read --roller 77 may--.

COLUMN 32

Line 19, "spacing a" should read --spacing $\alpha$--; and
Line 22, "gap a" should read --gap $\alpha$--.

COLUMN 33

Line 14, "preferably one" should read --preferably be one--.

COLUMN 34

Line 56, "The" should read --¶ The--.

COLUMN 36

Line 5, "terms" should read --terms of--.

COLUMN 38

Table 1, "Before modificatoin" should read --Before modification--; "After modificatoin" should read --After modification--; and under "After modification", row 8, second occurrence should be deleted.

UNITED STATES PATENT AND TRADEMARK OFFICE

CERTIFICATE OF CORRECTION

PATENT NO. : 5,750,303

DATED : May 12, 1998

INVENTOR(S) : KOHJI INABA, ET AL.

It is certified that error appears in the above-identified patent and that said Letters Patent is hereby corrected as shown below:

COLUMN 41

Line 2, "(dia.=0.20 mm)" should read --dia.=20 mm)--; and
Line 6, "an" should read --a--.

COLUMN 42

Table 3, under col. "Toluene-insoluble content (%)", "15.3" should read --16.3--.

COLUMN 43

Table 5-1, under col. "Ex. or Comp. Ex.", "Comp. Ex. 1" should read --Comp. Ex.--; and
Table 5-2, under col. "Ex. or Comp. Ex.", "Ex. 1" should read --Ex.--.

COLUMN 45

Table 5-2, under col. "Ex. or Comp. Ex.", "Comp. Ex. 1" should read --Comp. Ex.--; and
Table 5-3, under col. "Ex. or Comp. Ex.", "Ex. 1" should read --Ex.--;
in the row "Ex. No. 5", "1.52" should read --1.53--; and
under col. "Ex. or Comp. Ex.", "Comp. Ex. 1" should read --Comp. Ex.--.

UNITED STATES PATENT AND TRADEMARK OFFICE

CERTIFICATE OF CORRECTION

PATENT NO. : 5,750,303

DATED : May 12, 1998

INVENTOR(S) : KOHJI INABA, ET AL.

*It is certified that error appears in the above-identified patent and that said Letters Patent is hereby corrected as shown below:*

COLUMN 47

Table 5-4, "HT/NH" should read --HT/HH--;
under col. "Ex. or Comp. Ex.",
"Ex. 1" should read --Ex.-- and
"Comp. Ex. 1" should read -- Comp. Ex.--; and
Table 5-5, "under col. "Ex. or Comp. Ex.",
"Ex. 1" should read --Ex.--; and
"Comp. Ex. 1" should read --Comp. Ex.--;
under heading "Initial stage", under col. "Halftone image", "DCCDCC" should read --CDCCDC--;
under heading "Initial stage", under col. "Solid image", "DCCDCC" should read --CDCCDC--; and
under heading "Initial stage", under col. "Fog (%)", "DCCDCC" should read --CDCCDC--.

COLUMN 49

Table 6, "Toluene-insolube" should read --Toluene-insoluble--.

COLUMN 51

Line 34, "(Mw(cal.))" should read --(Mn(cal.))--.

COLUMN 52

Line 47, "MW/Mn" should read --Mw/Mn--.

UNITED STATES PATENT AND TRADEMARK OFFICE

CERTIFICATE OF CORRECTION

PATENT NO. : 5,750,303

DATED : May 12, 1998

INVENTOR(S) : KOHJI INABA, ET AL.

It is certified that error appears in the above-identified patent and that said Letters Patent is hereby corrected as shown below:

COLUMN 53

Line 3, "The" should read --The toner--;
Line 11, "aand" should read --a and--;
Line 16, "-25" should read --0-25--; and
Line 22, "aand" should read --a and--.

Signed and Sealed this

Thirteenth Day of April, 1999

*Attest:*

Q. TODD DICKINSON

*Attesting Officer*

*Acting Commissioner of Patents and Trademarks*